US007245842B2

(12) United States Patent
Hino

(10) Patent No.: US 7,245,842 B2
(45) Date of Patent: Jul. 17, 2007

(54) IMAGE FORMING APPARATUS, IMAGE FORMING SYSTEM, IMAGE FORMING CONDITION ADJUSTING METHOD, COMPUTER PROGRAM CARRYING OUT THE IMAGE FORMING CONDITION ADJUSTING METHOD, AND RECORDING MEDIUM STORING THE PROGRAM

(75) Inventor: Makoto Hino, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 215 days.

(21) Appl. No.: 10/991,381

(22) Filed: Nov. 19, 2004

(65) Prior Publication Data

US 2005/0117928 A1 Jun. 2, 2005

(30) Foreign Application Priority Data

Nov. 27, 2003 (JP) ..... 2003-397566

(51) Int. Cl.
*G03G 15/00* (2006.01)

(52) U.S. Cl. ..... 399/49; 399/72

(58) Field of Classification Search ..... 399/38, 399/39, 46, 49, 50, 51, 53, 72; 347/115; 358/298

See application file for complete search history.

(56) References Cited

U.S. PATENT DOCUMENTS 5,565,995 A * 10/1996 Yamada et al. ..... 358/3.02
6,429,886 B2 * 8/2002 Ohki ..... 347/115
6,483,997 B1 * 11/2002 Nakazato ..... 399/46
6,560,418 B2 * 5/2003 Campbell et al. ..... 399/49
6,785,481 B2 * 8/2004 Bray et al. ..... 399/49

FOREIGN PATENT DOCUMENTS

| | | |
|---|---|---|
| JP | 5-313453 | 11/1993 |
| JP | 10-23191 | 1/1998 |
| JP | 2001-215761 | 8/2001 |
| JP | 2001-222197 | 8/2001 |
| JP | 2001-358941 | 12/2001 |
| JP | 2002-40725 | 2/2002 |
| JP | 2002-214865 | 7/2002 |

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus including: at least one image forming unit including an image bearing member bearing a latent image and a developing device configured to develop the latent image with a developer including a toner to form a toner image thereon; optionally an intermediate transfer configured to receive the toner image from the image bearing member; a transfer device configured to transfer the toner image to a receiving material; an image pattern measuring device configured to evaluate at least a formal property of a test toner image formed on the image bearing member or the intermediate transfer medium; an image quality predicting device configured to predict image qualities of the toner image to be formed on the receiving material on the basis of the evaluation data; and an image forming condition adjusting device configured to adjust image forming conditions on the basis of the image quality prediction data.

28 Claims, 14 Drawing Sheets

FIG. 5
700
| RECEIVER'S IDENTIFIER 700a | RECEIVER'S NAME 700b | TYPE OF APPARATUS 700c | IDENTIFICATION INFORMATION 700d |
|---|---|---|---|
| | | | |
| | | | |
| | | | |
| | | | |
| | | | |
FIG. 6
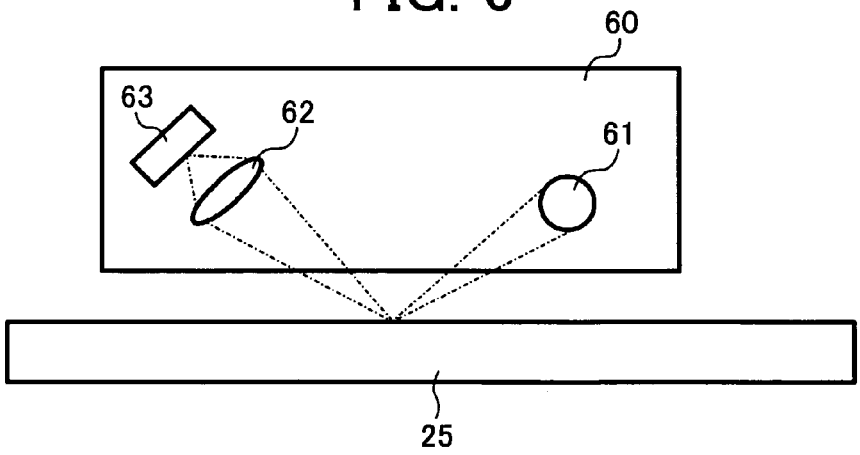
FIG. 7
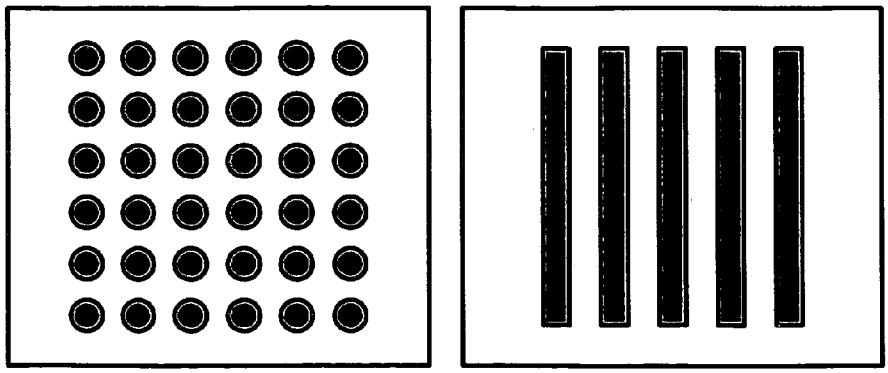

IMAGE FORMING APPARATUS, IMAGE FORMING SYSTEM, IMAGE FORMING CONDITION ADJUSTING METHOD, COMPUTER PROGRAM CARRYING OUT THE IMAGE FORMING CONDITION ADJUSTING METHOD, AND RECORDING MEDIUM STORING THE PROGRAM

BACKGROUND OF THE INVENTION

1. Field of the Invention

The present invention relates to an image forming apparatus and system. More particularly, the present invention relates to an image forming apparatus and system in which the image qualities of images to be output by the image forming apparatus are predicted from the evaluation data of test images (internally prepared pattern images) and image forming conditions are adjusted on the basis of the data to produce high quality images. In addition, the present invention also relates to an image forming condition adjusting method, a computer program for carrying out the image forming condition adjusting method, and a recording medium for storing the computer program.

2. Discussion of the Background

Recently, there is an increasing need for high-speed complex image forming apparatus in which conventional facsimile machines, copiers and printers are combined and in which images are formed at a high speed while effectively using a network.

In attempting to stably produce high quality images using such complex image forming apparatus, techniques such that a test image is internally formed in an image bearing member such as photoreceptors and intermediate transfer media; the average reflectivity or image density of the test image is measured using a detector such as photosensors; and the image forming conditions are adjusted on the basis of the measurement data are known. In addition, techniques such that an image is practically formed on a recording medium such as papers; the image qualities of the output image are evaluated; and the image forming conditions are adjusted on the basis of the measurement data, to prevent formation of abnormal images such as fine character images with low resolution caused by deterioration of the developer used, are also known.

Published unexamined Japanese patent application No. (hereinafter referred to as JP-A) 2002-040725 discloses a technique in that a test image is formed on an image bearing member; the image density thereof is measured with a detector such as photosensors; it is determined whether the image density falls in a desired range; and the image forming conditions are adjusted on the basis of the measurement data to prevent formation of abnormal images such as fine character images with low resolution caused by deterioration of the developer used.

JP-A 2001-215761 discloses a technique in that a test image is formed on an image bearing member; the amount of the toner in the test image is measured with a detector such as photosensors; and the current of the transfer bias is adjusted on the basis of the measurement data.

JP-A 05-313453 discloses a technique in that test images (such as dot images and line images) having different areas are formed on an image bearing member; the image densities of the test images are measured with a detector such as photosensors; and image forming conditions are adjusted on the basis of the measurement results, to prevent production of images with low resolution.

In the measurement methods described in JP-As 2002-040725, 215761 and 05-313453 mentioned above, the average reflectivity or image density of toner images formed on a photoreceptor or an intermediate transfer medium is measured with a photosensor and the process conditions are adjusted on the basis of the measurement data to prevent formation of abnormal images. However, the reflectivity and image density tend to be influenced by characteristics of the photoreceptor and intermediate medium (hereinafter referred to as image bearing members). For example, when the materials or lots of such image bearing members are changed, it is often necessary that service men change the reference values of the reflectivity and image density.

It is well known that granularity, clearness and gradation property of images are very important image qualities. Among these image qualities, only the gradation property is evaluated on average and process conditions are adjusted on the basis of the evaluation data in the techniques mentioned above. Namely, variation of the gradation property in a one or two dimensional direction is not considered. In addition, deterioration of the granularity and clearness is not considered in these techniques, i.e., the process conditions are not adjusted while considering granularity and clearness.

JP-A 2002-214865 discloses a technique in that image forming conditions of an image outputting device are detected; the detection data are sent to an image processing apparatus; the controlling device of the image processing apparatus controls the image forming conditions of the image outputting device on the basis of the sent image forming conditions, to stably produce desired images.

In this technique, images to be evaluated are formed on a recording material such as papers and process conditions are adjusted depending on the evaluation data. Therefore, the running costs increase. In addition, when an output instruction is made by an apparatus other than the image processing apparatus, which is connected with the output device through a network, the controlling device of the image processing apparatus does not have an ability to select a proper output device or a proper image processing method. Namely, the system cannot make good use of the apparatuses connected through a network.

On the other hand, a large number of images are output by the above-mentioned high-speed image forming apparatus, and thereby a large amount of waste developer is produced. Therefore, there is a probability that the waste developer causes environmental pollution. In attempting to avoid such a problem (i.e., to effectively use the developer), current image forming apparatus typically adopt a toner recycling system in which particles of the developer (toner) remaining on the image bearing member are collected by a cleaning device and the collected developer particles are fed to the developing device to be reused.

JP-A 2001-7222197 discloses a technique in that image qualities are predicted on the basis of data concerning the mixing ratio of the recycled developer particles to virgin developer particles; and the time at which the developer is to be replaced with a virgin developer is informed, to reduce the running costs of the output device and to increase the operational efficiency of the output device.

In this technique, image qualities are predicted on the basis of only the developer mixing ratio data, i.e., image qualities of a real image are not evaluated. Since the characteristics of a developer greatly change depending on environmental conditions, there is a probability of occurrence of a problem in that the replacement time at which the developer is to be replaced with a virgin developer comes earlier than the predicted replacement time. Alternatively, there is a probability that the developer used has to be replaced with a virgin developer even when the developer has no problem.

JP-A 2001-358941 discloses a technique in that the image qualities of images output by an image forming apparatus are evaluated; the evaluation data, which are repeatedly obtained, are stored in a memory, which is connected with a network, to accumulate data; and an image processing apparatus selects a proper image processing method on the basis of the evaluation data.

In this technique, images to be evaluated are formed on recording materials such as papers and process conditions are adjusted on the basis of the evaluation data. Therefore, the running costs increase. In addition, when an output instruction is made by an apparatus other than the image processing apparatus through a network, it is difficult to select a proper output device. Namely, the system cannot make good use of the apparatuses connected through a network.

Because of these reasons, a need exists for an image forming apparatus and system capable of producing high quality images without abnormal images using a method in which a toner image formed on an image bearing member is evaluated without using receiving materials and the image forming conditions are adjusted on the basis of the evaluation data while considering granularity, clearness and gradation property of images.

SUMMARY OF THE INVENTION

Accordingly, an object of the present invention is to provide an image forming apparatus and system which can produce high quality images without abnormal images using a method, in which a toner image formed on an image bearing member is evaluated without using receiving materials and the image forming conditions are adjusted on the basis of the evaluation data while considering granularity, clearness and gradation property of images, and which can satisfy the customers in view of image qualities and running costs.

Another object of the present invention is to provide an image forming condition adjusting method by which high quality images can be stably produced without producing abnormal images.

Yet another object of the present invention is to provide a computer program and a recording medium including the program which is used for producing high quality images without abnormal images.

Briefly these objects and other objects of the present invention as hereinafter will become more readily apparent can be attained by an image forming apparatus including:

at least one image forming unit including:

an image bearing member configured to bear an electrostatic latent image thereon; and a developing device configured to develop the electrostatic latent image with a developer including a toner to form a toner image on the image bearing member;

a transfer device configured to transfer the toner image on a receiving material optionally via an intermediate transfer medium;

an image pattern measuring device configured to measure at least one formal property of a test toner image formed on the image bearing member or the intermediate transfer medium;

an image quality predicting device configured to predict the image qualities of the toner image to be formed on the receiving material on the basis of the evaluation data of the formal property; and an image forming condition adjusting device configured to adjust image forming conditions on the basis of the image quality prediction data.

It is preferable that the image forming apparatus further comprises:

a developer supplying device which is exchangeable and which is configured to store and supply the developer to the developing device;

a developer collecting device which is configured to collect particles of the toner, which are adhered to the image bearing member but are not used for forming the toner image, wherein the developer collecting device feeds the collected toner particles to the developer supplying device; and a mixed developer quality determining device configured to determine the quality of a mixed developer of virgin toner particles and the collected toner particles contained in the developer supplying device;

wherein the image forming condition adjusting device determines the image forming conditions on the basis of the image quality prediction data and the quality of the mixed toner.

It is preferable that the image forming conditions are at least one of (1) quantity of charge applied to the image bearing member, (2) light quantity of light irradiating the image bearing member to form the latent image, (3) a developing bias applied to the developing device when the latent image is developed, and (4) a transfer bias applied to the transfer device when the toner image is transferred to the receiving material.

It is preferable that the image forming apparatus repeats the test image formation, the test image evaluation, the image quality prediction and the image forming condition adjustment at a predetermined time to determine the final image forming conditions.

When a plurality of color toner images are formed using a plurality of image forming units to produce a multi-color image, the test image formation, the test image evaluation, the image quality prediction and the image forming condition adjustment are performed on each image forming unit.

The image pattern measuring device preferably measures at least one of (1) a combination of the average of areas of the dots constituting the test image and the standard deviation of the areas; (2) a combination of the average of diameters of the same-area circles having the same are of the dots and the standard deviation of the diameters; and (3) a combination of the line width of the test image and width of edge of the test images.

The image pattern measuring device preferably evaluates the test toner image while disregarding toner particles which constitute the test toner image but have a particle size not greater than a predetermined particle size.

The image pattern measuring device preferably comprises a light irradiator configured to irradiate the test image on the image bearing member or the intermediate transfer medium with light beams which are substantially parallel to each other; a focusing member configured to focus the light beams reflected from the test image on the bearing member or the intermediate transfer medium to form a light image of the test image; a photoelectric transfer member configured to subject the light image to a photoelectric treatment; and an image analyzer configured to analyze the light image.

The image qualities predicted by the image quality predicting device preferably include granularity, clearness and gradation property.

The image quality predicting device preferably predicts the granularity of the toner image t be output on the basis of the data concerning the standard deviation of the areas of the dots constituting the test image or the standard deviation of the diameters of the same-area circles of the dots.

The image quality predicting device preferably predicts the gradation property on the basis of either the average area of the dots of the test image or the average diameter of the same-area circles of the dots and the line density of the test image.

The image quality predicting device preferably predicts the clearness from MTF (Modulation Transfer Function) at a predetermined spatial frequency, which is determined on the basis of the line width of the test image and the width of edge of the test image.

The image quality predicting device preferably predicts the image qualities by comparing a Mahalanobis distance of the formal property of the test image with that of the predetermined Mahalanobis distance which are determined by analyzing images having good image qualities.

It is preferable that the image forming apparatus further includes a network connecting device configured to connect the image forming apparatus with a terminal device through a network, wherein the image forming apparatus sends the evaluation data and/or the prediction data to the terminal device through the network when requested by the terminal device. Alternatively, the image forming apparatus may periodically send the data to the terminal device.

It is preferable that the image forming apparatus further includes an informing device configured to send information that the image qualities deteriorate to a registered person when the predicted image quality is not better than the predetermined image quality.

The image forming apparatus preferably determines whether the developer is to be replaced with a virgin developer on the basis of the image quality prediction data obtained after performing in plural times the test image formation, the test image evaluation, the image quality prediction and the image forming condition adjustment, wherein when it is determined that the developer is to be replaced with a virgin developer, the informing device sends the information to a registered person.

As another aspect of the present invention, an image forming system is provided which comprises:

one or more of the image forming apparatus mentioned above; and a terminal device which requests at least one of the one or more the image forming apparatus, through a network, to output an image according to image data processed by the terminal device, wherein the terminal device prepares the image data by a most suitable image processing method which is determined on the basis of the image quality prediction data of an image to be output by the image forming apparatus, which are provided by the image quality predicting device of the image forming apparatus, and/or the test image evaluation data provided by the image pattern measuring device thereof.

The image forming system may include two or more of the image forming apparatus mentioned above, and the terminal device requests at least one of the image forming apparatuses to output an image through a network, wherein the terminal device includes an image forming apparatus selecting device configured to request the two or more of the image forming apparatuses to send the image quality prediction data and/or the measurement data to select at least one of the plurality of image forming apparatus on the basis of the data, to which the terminal device requests to output the image through the network.

Alternatively, the image forming system may include a result storing device in which the data of each of the apparatuses are stored while associated with the apparatus, and an image forming apparatus selecting device configured to select at least one of the image forming apparatus on the basis of the data stored in the result storing device to request to output an image, wherein the terminal device periodically requests the plurality of image forming apparatus to send the image quality prediction data and/or the evaluation data.

In this case, the plurality of image forming apparatus may periodically send the image quality prediction data and/or the evaluation data to the terminal device without request from the terminal device.

It is preferable for the image forming system mentioned above that the image forming apparatus selecting device selects at least one among the two or more of the image forming apparatus on the basis of the data stored in the result storing device and characteristics or kinds of the image to be output, and the terminal device determines a most suitable image processing method on the basis of the data stored in the result storing device and characteristics or kinds of the image to be output.

As a yet another aspect of the present invention, an image forming condition adjusting method for adjusting an image forming condition of an image forming apparatus is provided which includes:

forming a test toner image on an image bearing member of the image forming apparatus using a developer including a toner;

evaluating at least one formal property of the test toner image;

predicting image qualities of a toner image to be output by the image forming apparatus on the basis of the formal property data of the test toner image; and adjusting image forming conditions of the image forming apparatus on the basis of the image quality prediction data.

It is preferable that the image forming condition adjusting method further includes:

determining properties of the developer which includes a mixture of a virgin toner and a collected toner, wherein the image quality prediction is performed on the basis of the formal property data of the test toner image and the properties of the developer.

As a further aspect of the present invention, a computer program product is provided which is stored in a computer readable storage medium and which carries out the image forming condition adjusting method mentioned above.

As a still further aspect of the present invention, a computer readable storage medium is provided which stores computer instructions for carrying out the image forming condition adjusting method mentioned above.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 5 is a schematic view illustrating an embodiment of data concerning information of the receivers, which data are stored in a management table;

FIG. 6 is a schematic view illustrating an embodiment of the pattern detector included in the image forming apparatus of the present invention;

FIG. 7 is a schematic view illustrating an embodiment of the test image (dot image and line image) formed on the image bearing member (or intermediate transfer medium) of the image forming apparatus of the present invention;

DETAILED DESCRIPTION OF THE INVENTION

Figure 1:
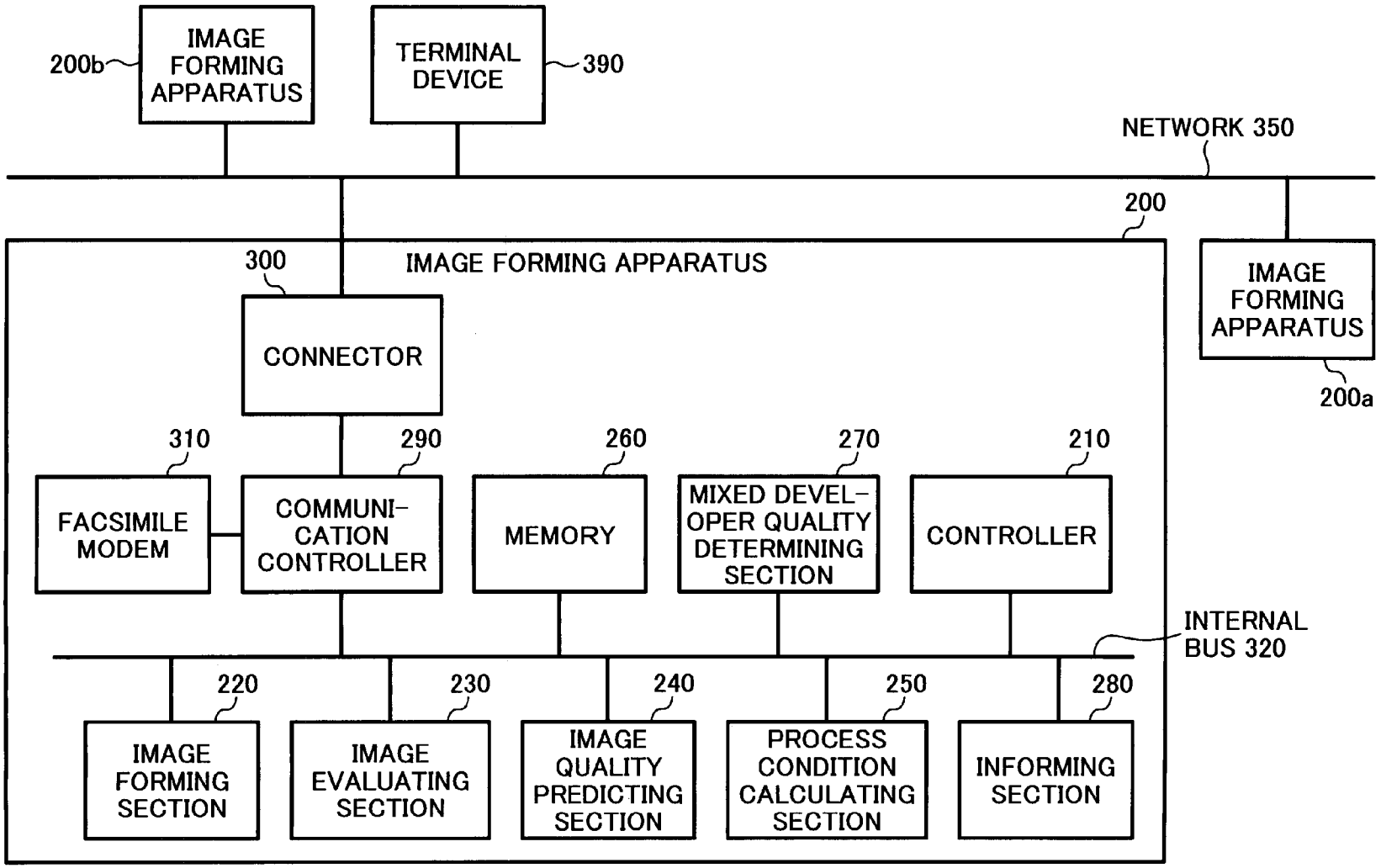
FIG. 1 is a block diagram illustrating the entire structure of an embodiment of the image forming system of the present invention.

According to the present invention, an image forming apparatus is provided which can stably produce high quality images without abnormal images by predicting the qualities of an image to be output on the basis of the evaluation data of at least a formal property of a test image formed on a photoreceptor or an intermediate transfer medium and determining the image forming conditions in view of granularity, clearness and gradation property of the image to be output. Therefore the image forming apparatus can satisfy the customers in view of image qualities and running costs.

The image forming apparatus of the present invention has the following advantages over conventional image forming apparatus having a function such that image forming conditions are adjusted on the basis of the estimation data of a test image.

(1) The evaluation method is not relatively influenced by noises such as uneven density of a test image formed on an image bearing member such as photoreceptors and intermediate transfer media compared with conventional evaluation methods in which the image density of a test image is measured by a method using a photosensor, or the like methods.

(2) The image qualities of an image to be output are precisely predicted because the prediction is based on the precise evaluation of the test image.

(3) The image forming conditions are effectively adjusted on the basis of the precise image quality prediction, so that images having good image qualities with which the customers can be visually satisfied can be stably produced without producing abnormal images.

(4) Even when the materials of the image bearing member such as photoreceptors and intermediate transfer media are changed, it is not necessary for service men to change the reference values with which the evaluation data of a test image are compared. Namely, the preciseness of adjustment of image forming conditions can be improved, resulting in improvement of reliability of the image forming apparatus.

(5) The operation rate of the image forming apparatus is relatively high compared to that of conventional image forming apparatuses because it is not necessary for service men to change the reference values.

(6) Since the image qualities of a test image formed on an image bearing member are evaluated and then the image forming conditions are adjusted on the basis of the evaluation data, it is not necessary to use receiving materials such as papers, resulting in reduction of running costs (i.e., reduction of TCO (Total Cost of Ownership)).

(7) Since the image forming apparatus has a function such that when the predicted image quality is lower than the predetermined reference value, the information is provided to a preliminarily registered person or a maintenance person, the customers need not to check whether the image qualities deteriorate or the performance of the image forming apparatus deteriorates.

(8) Since the down time of the image forming apparatus due to deterioration of image qualities can be shortened for the reason described in paragraph (7), the reliability of the image forming apparatus can be improved and the operation rate of the image forming apparatus can be further improved.

(9) Apparatus maintainers such as service centers and service men can easily notice that the performance of the image forming apparatus deteriorates, and thereby a quick action can be made for troubles of the image forming apparatus. Namely, the quality and speed of maintenance can be improved, thereby differentiating the maintenance service from that of competitors.

(10) The image forming apparatus has a toner recycling mechanism configured to collect particles of the developer (toner particles) remaining on image bearing members such as photoreceptors and intermediate transfer media and return the collected toner particles to the developing device to reuse the toner particles. The time at which the developer is to be replaced with a virgin developer can be predicted by the data on the qualities of the mixed developer of a virgin toner and the reused toner and the image quality evaluation data of a test image. This information (replacement of developer) can be indicated by an indicator or can be notified to a service center or a registered person in charge of the image forming apparatus through a network. Therefore the developer can be timely replaced without performing unnecessary replacement of developer, resulting in decrease of the amount of waste developer and prevention of environmental pollution. In addition, the replacement operation can be rapidly performed, and thereby the quality of service can be improved.

(11) Even when the developer deteriorates, the image qualities can be improved by adjusting the image forming conditions. Therefore, the life of the developer can be prolonged, resulting in reduction of running costs.

(12) Since a terminal device in the image forming system of the present invention stores, in its memory, the evaluation data of images output by image forming apparatuses connected with the terminal device through a network, the terminal device can grasp the image qualities of latest images output by the image forming apparatuses. Therefore, the terminal device can select the most suitable image forming apparatus and the most suitable image forming method, and thereby high quality images can stably be produced. Thus, customers are satisfied and low cost image forming operations can be realized.

Then the present invention will be explained referring to drawings.

FIG. 1 illustrates the entire structure of an embodiment of the image forming system of the present invention.

The image forming system includes an image forming apparatus 200, a local area network 350 (hereinafter sometimes referred to as a LAN 350), and a terminal device 390. A plurality of image forming apparatuses and a plurality of terminal devices can be connected with the LAN 350, if desired.

The image forming apparatuses 200, 200*a* and 200*b* have a function such that the image qualities of an image to be output are predicted on the basis of the evaluation data of a test image formed on an image bearing member (a photoreceptor or an intermediate transfer medium), and the image forming conditions are adjusted on the basis of the evaluation data. The terminal device 390 has a function such that when it is requested to output an image, the terminal device selects the most suitable image forming method on the basis of the evaluation data and the image quality estimation data.

The image forming apparatuses 200, 200*a* and 200*b* and the terminal device 390 are connected with the LAN 350. The LAN 350 is connected with an external network through a router (not shown). In addition, a terminal device or a personal computer (both are not shown) which the maintenance company (or a service man or a service center) uses is connected with the external network.

Figure 2:
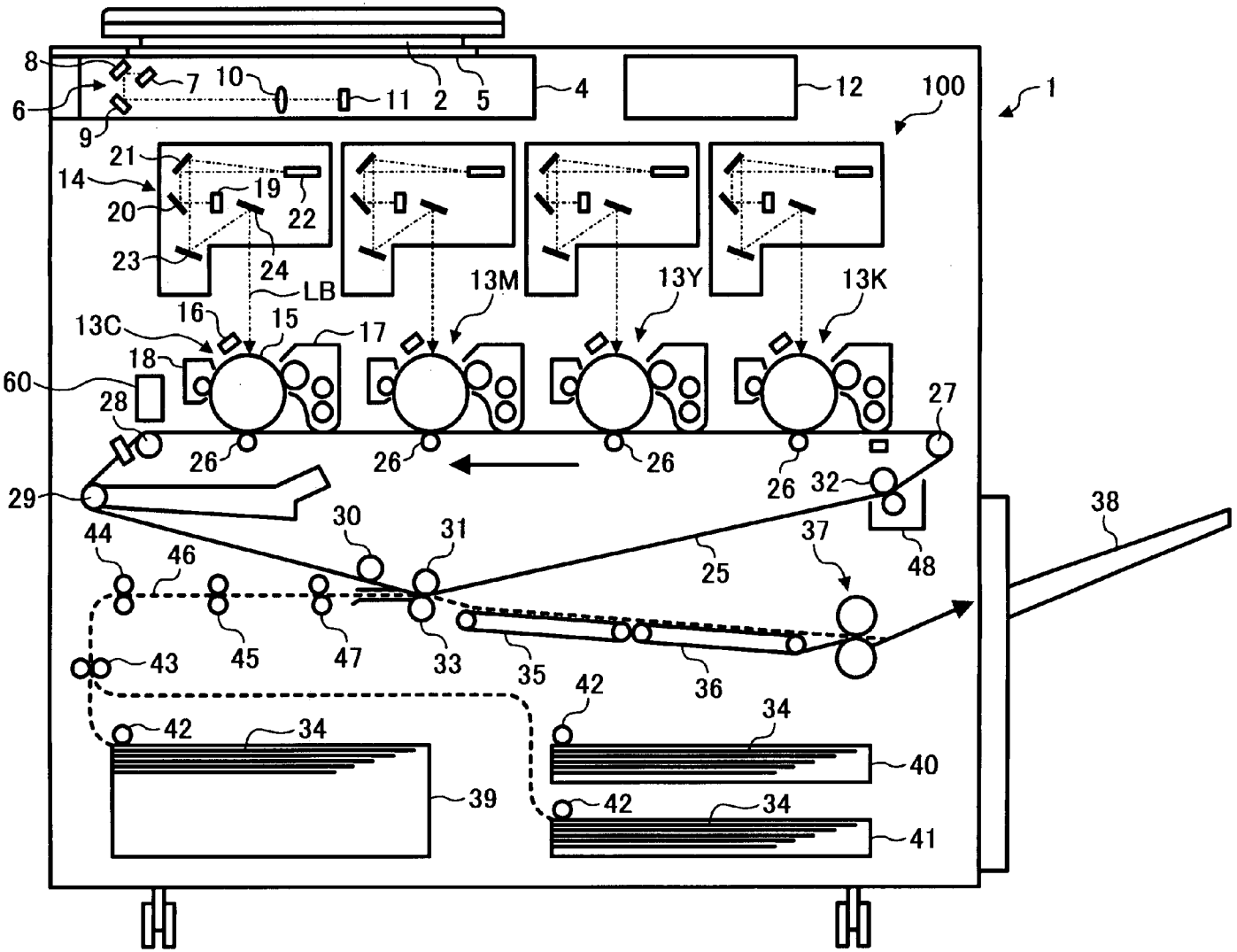
FIG. 2 is a schematic view illustrating an embodiment of the image forming apparatus of the present invention.

FIG. 2 is a schematic view illustrating an embodiment of the image forming apparatus of the present invention. The image forming apparatus of the present invention can be applied to complex image forming apparatus, copiers and printers (monochrome laser printers and digital color printers) in which a toner image is formed on a photoreceptor and the toner image is transferred to a receiving material; color toner images formed on one or more photoreceptors are transferred on an intermediate transfer medium and the color toner image is transferred to a paper sheet at once to form a multi-color image; or color toner images are transferred from one or more photoreceptors to a paper sheet one by one to form a multi-color image. The image forming apparatus of this embodiment, which is illustrated in FIG. 2, is a tandem type digital color printer.

An image forming apparatus (tandem type digital color printer) 200 has an image reading device and can also serve as a color copier. Needless to say, the image forming apparatus 200 may be a printer which has no image reading device and which produces images according to image data output from the terminal device 390 such as personal computers.

Referring to FIG. 2, numeral 1 denotes a main body of the tandem type digital color printer. The main body 1 has an image input terminal (IIT) 4, which reads the image of an original 2, in an upper left portion thereof. In addition, the main body 1 has an image processing system (IPS) 12, which processes image data sent from an image input terminal 4 or a personal computer (not shown) through a public switched telephone network (PSTN) (not shown) or the LAN 350, in an upper right portion thereof. Further, the main body 1 has an image output terminal (IOT) 100, which outputs an image on the basis of the processed image data.

The image output terminal 100 has a plurality of image forming units 13K, 13Y, 13M and 13C which are arranged at regular intervals in the horizontal direction and which produce black, yellow, magenta and cyan color images, respectively. In addition, an intermediate transfer belt 25 on which the color images are transferred while overlaid to form a multi-color (full color) image and which is rotated in a direction indicated by an arrow is arranged below the image forming units 13K, 13Y, 13M and 13C.

The color toner images overlaid on the intermediate transfer belt 25 are transferred at once to a receiving paper 34 serving as a receiving material, which is fed from a paper tray 39, 40 or 41. The toner images are then fixed on the receiving paper 34 by a fixing device 37.

In this embodiment, the black, yellow, magenta and cyan color images formed by the image forming units 13K, 13Y, 13M and 13C, respectively, are transferred on the intermediate transfer belt 25 (first transfer) while overlaid to form a multi-color image, and the multi-color image on the intermediate transfer belt 25 is transferred on the receiving paper 34 at once (second transfer). However, the image forming apparatus of the present invention is not limited thereto, and the color images can be directly transferred one by one to the receiving paper 34 fed by paper feeding belts 35 and 36 to form a multi-color image. In addition, the order of the image forming units is not limited to black, yellow, magenta and cyan, and orders such as an order of yellow, magenta, cyan and black are also possible.

Then the image forming apparatus 200 will be explained in detail.

In an upper portion of the main body 1, a platen cover is provided to press the original 2 to a platen glass 5, and the image input terminal 4 which reads the image of the original 2 set on the platen glass 5 is also provided. The image input terminal 4 irradiates the original 2 with light emitted by a light source 6. The light reflected from the original 2 scans an image reading element 11 such as charge coupled devices (CCD) after passing through a reduced optical device including a full rate mirror 7, half rate mirrors 8 and 9, and a focusing lens 10. Thus, the color image of the original 2 is read by the image reading element 11 at a predetermined dot density (for example, 16 dots/mm).

The color light image thus read by the image reading device 4 is sent to the image processing system 12 after converted to reflectivity data of red, green and blue colors with 8 bits. Then the image processing system 12 subjects the data to processing such as shading correction, position correction, brightness/color space conversion, gamma correction, frame erasure, color movement/editing and the like processing.

By being subjected to the image processing, the image data are converted to 8-bit four color gradation data (raster data), i.e., 8-bit data of yellow, magenta, cyan and black color images. The data are then sent to raster output scanners (ROS) 14 for the respective image forming units 13K, 13Y, 13M and 13C. Each of the raster output scanners 14 image-wise irradiates a corresponding photoreceptor with a laser beam while scanning according to the corresponding color gradation data.

Figure 3:
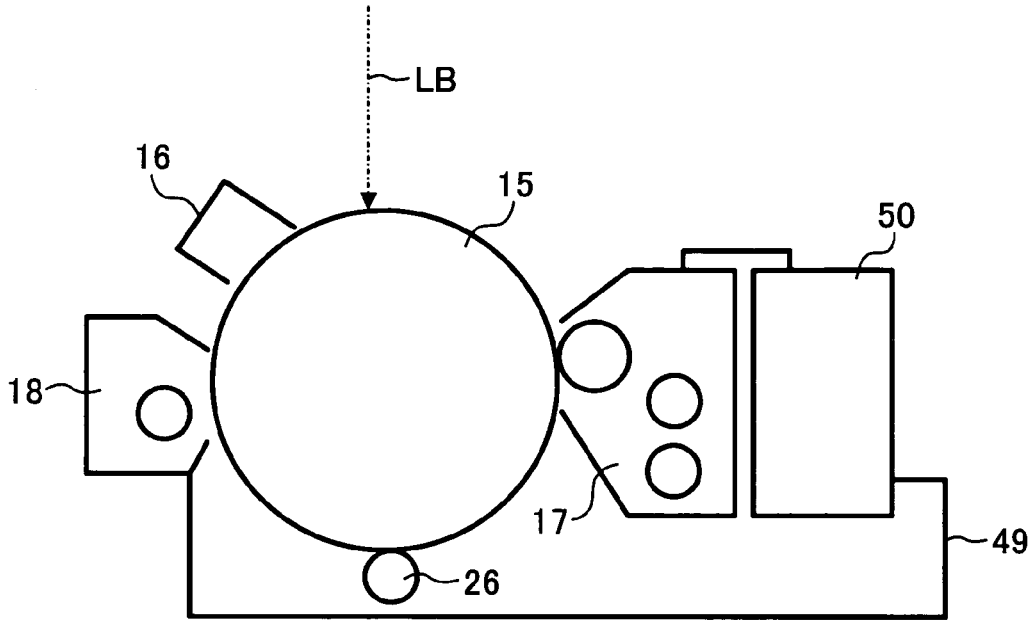
FIG. 3 is a schematic view illustrating an image forming unit for use in the image forming apparatus of the present invention.

As can be understood from FIGS. 2 and 3, the four image forming units 13K, 13Y, 13M and 13C have the same structure. Each image forming unit 13 has a photoreceptor drum 15 which rotates in a predetermined direction at a predetermined rotation speed; a scorotron 16 which serves as a primary charger and charges the photoreceptor drum 15; the raster output scanner 14 which serves as an image irradiator and which irradiates the photoreceptor drum 15 with a laser beam to form an electrostatic latent image on the photoreceptor drum 15; a developing device 17 which develops the electrostatic latent image with a developer including a toner to form a toner image on the photoreceptor drum 15; a cleaning device 18 which cleans the surface of the photoreceptor drum 15; a toner supplying pipe 49 through which the toner particles collected by the cleaning device 18 are fed to a toner hopper 50; and the toner hopper 50 (i.e., toner replenishing portion) through which a virgin toner and the collected toner are supplied to the developing device 17.

As illustrated in FIG. 2, the raster output scanner 14 modulates a laser diode 19 according to the original color gradation data so that the laser diode 19 emits a laser beam LB according to the color gradation data. The laser beam emitted by the laser diode 19 is scanned by a polygon mirror 22 via reflection mirrors 20 and 21 so as to be deflected. Then the laser beam LB is reflected by the reflection mirrors 20 and 21 and a plurality of reflection mirrors 23 and 24 and irradiates the surface of the photoreceptor drum 15 while scanning.

Thus, the color image data of black, yellow, magenta and cyan images are output from the image processing device 12, and the respective raster output scanners 14 irradiate the respective photoreceptor drums 15 according to the respective color image data, resulting in formation of respective electrostatic latent images on the respective photoreceptor drums 15. The thus prepared latent images are developed with the respective developing devices 17 and thereby a black toner image, a yellow toner image, a magenta toner image, and a cyan toner image are formed on the respective photoreceptor drums 15.

The thus prepared color toner images are transferred to the intermediate transfer belt 25 so as to be overlaid, by respective primary transfer rollers 26, resulting in formation of a full color toner image on the intermediate transfer belt 25. The intermediate transfer belt 25 is rotated while stretched at a predetermined tension by a drive roller 27, a stripping roller 28, a steering roller 29, an idling roller 30, a backup roller 31 and an idling roller 32. The drive roller 27 is rotated by a special driving motor (not shown) which has good constant-speed rotation property, and thereby the intermediate transfer belt 25 is rotated by the drive roller 27 at a predetermine speed in a direction indicated by an arrow.

For example, an endless belt which is prepared by connecting both ends of a belt-form film made of a flexible resin such as polyimide by a welding method or the like can be used for the intermediate transfer belt 25.

The color toner images overlaid on the intermediate transfer belt 25 are secondly transferred to the receiving paper 34 by a second transfer roller 33, which pressure-contacts with the backup roller 31, upon application of pressure and electrostatic force to the receiving paper 34. The color toner images on the receiving paper 34 are fixed thereon by the fixing device 37 upon application of heat and pressure thereto. Then the receiving paper 34 bearing the fixed color toner image is discharged from the main body 1 and stacked on a discharge tray 38.

The receiving paper 34 is fed from any one of the plurality of paper trays 39, 40 and 41 so that a paper sheet with a desired size is supplied to the image forming units. The receiving paper 34 is fed by a feed roller 42, and plural pairs of rollers 43, 44 and 45, which constitute a paper feeding passage 46. The thus fed receiving paper 34 is fed to a pair of registration rollers 47. Then the receiving paper 34 is timely fed to the intermediate transfer belt 25 by the registration rollers 47 which start to rotate at a predetermined time.

As mentioned above, the black, yellow, magenta and cyan toner images which have been prepared by the image forming units 13K, 13Y, 13M and 13C are transferred to the thus fed receiving paper 34 one by one at predetermined times.

After the toner image transferring operation, the photoreceptor drums 15 are cleaned by the respective cleaning devices 18. Namely, toner particles, paper dust, etc., remaining on the photoreceptor drums 15 are removed by the cleaning devices 18. The residual toner particles collected by the cleaning devices 18 are fed to the toner hopper 50 by a feeding screw (not shown) through the toner feeding pipe 49 to be mixed with a virgin toner. The toner hopper 50 supplies the mixed developer to the developing device 17 so that the mixed developer is used for developing latent images. The toner particles remaining on the intermediate transfer belt 25 are removed by a belt cleaner 48.

The toner hopper 50 is exchangeably set at a predetermined position.

Referring back to FIG. 1, the image forming apparatus 200 includes a controller 210, an image forming section 220, an image evaluating section 230, an image quality predicting section 240, a process condition calculating section 250, a memory 260, a mixed developer quality determining section 270, an informing section 280, a communication controller 290, an internal bus 320, a connector 300 and a facsimile modem 310.

As illustrated in FIG. 1, the controller 210, image forming section 220, image evaluating section 230, image quality predicting section 240, process condition calculating section 250, memory 260, mixed developer quality determining section 270, informing section 280 and communication controller 290 are connected with the internal bus 320, and they give and receive data and control instructions through the internal bus 320.

The controller 210 controls the entire of the image forming apparatus 200 and elements in the image forming apparatus 200. The image forming section 220 forms images under image forming conditions determined by the process condition calculating section 250. The image evaluating section 230 detects the test image formed on the photoreceptor or the intermediate transfer medium and evaluate the test image (i.e., measuring a formal property of the test image). The image quality predicting section 240 predicts the image qualities of an image to be output on a receiving material on the basis of the data of the evaluation of the test image, which is made by the image evaluating section 230.

The process condition calculating section 250 calculates suitable image forming conditions on the basis of the predicted image qualities, and sends the information about the image forming conditions to the image forming section 220.

The memory 260 temporarily stores the control program that the controller 210 executes, various data needed for executing the control program, and the calculation data and evaluation data provided by each section. In addition, the memory 260 serves as a work area of the controller 210.

The mixture developer quality determining section 270 determines the content of the collected toner in the developer to determine the quality of the developer (the mixed developer). Specifically, the content of the collected toner is determined by the following equation:

$$\text{Content of collected toner}=Z-X+Y$$

wherein X represents the amount of the toner which is originally contained in the toner hopper 50; Y represents the amount of the toner supplied to the developing device 17; Z represents the amount of the toner which is contained in the toner hopper at the time when the content of collected toner is determined.

The informing section 280 informs the image quality prediction data (the predicted image qualities of the image to be output), and information as to whether image qualities deteriorate and whether the developer is to be replaced with a virgin developer, to a registered person (e.g., customers of the image forming apparatus 200, a person in charge of managing the image forming apparatus 200, and/or a maintenance man in charge of the image forming apparatus 200).

The communication controller 290 performs communication controlling and is connected with the facsimile modem 310, through which the image forming apparatus 200 is connected with a PSTN when used for G3 facsimile transmission, and the connector 300, through which the image forming apparatus 200 is connected with the LAN 350.

The connector 300 has a NIC (network interface card) and connects the image forming apparatus 200 with an ETHERNET® cable serving as the LAN 350. The connector 300 has a transmission control function such as TCP/IP and SMTP/POP.

The facsimile modem 310 has a function of G3 facsimile modem.

Figure 4:
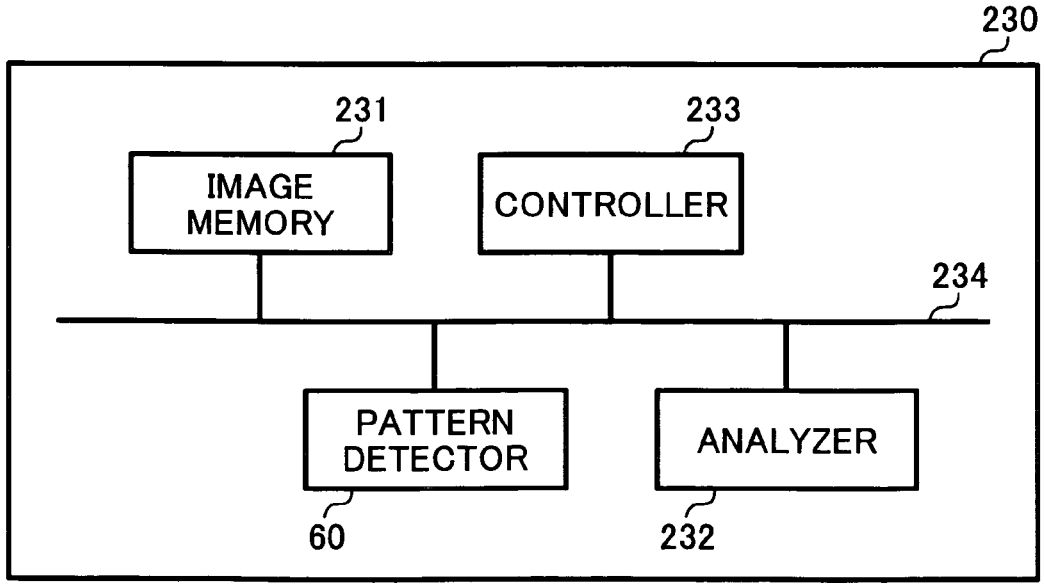
FIG. 4 is a block diagram illustrating an image evaluating device for use in the image forming apparatus of the present invention.

FIG. 4 is a block diagram illustrating the image evaluating section 230 of the image forming apparatus 200 of the present invention. Referring to FIG. 4, the image evaluating section 230 includes a pattern detector 60, an image memory 231, an analyzer 232, a controller 233 and an internal bus 234.

The pattern detector 60, image memory 231, analyzer 232 and controller 233 are connected with the internal bus 234 to send and receive data and control instructions.

The controller 233 performs controlling and controls the entire of the image evaluating section 230 and each element.

The pattern detector 60 detects the test image formed on the photoreceptor or intermediate transfer medium, and reads the test image.

The image memory 231 temporarily stores the image read by the pattern detector 60 and the measurement data provided by the analyzer 232 as a result of analysis of the test image.

The analyzer 232 analyzes the test image read by the pattern detector 60 and produces data on formal properties such as dot area, standard deviation of the dot area, line width, line edge width, etc. The analyzer 232 stores the data in the memory 231 and sends the data to the image quality predicting section 240 of the image forming apparatus 200.

FIG. 5 illustrates an example of a management table 700 which stores information on the receiver to which various kinds of data and information provided by the image forming apparatus 200 are to be sent. The management table 700 includes following items.

Receiver's Identifier 700*a:*

The identifier of the receiver to which the information is to be sent is stored therein.

The identifier means identifiers of the person in charge of managing the image forming apparatus 200, users thereof and the maintenance man thereof.

Receiver's Name 700*b:*

The name of the receiver to which the information is to be sent is stored therein.

Type of Apparatus 700*c:*

The type of the apparatus of the receiver to which the information is to be sent is stored therein.

The type of the apparatus means, for example, a terminal device or a facsimile device.

Identification Information 700*d:*

The mail address, internet facsimile address (i.e., IP address or domain name of internet facsimile) and facsimile number of the receiver are stored therein.

FIG. 6 is a view illustrating the structure of an embodiment of the pattern detector 60 which reads the test image formed on the photoreceptor or the intermediate transfer medium. Referring to FIG. 6, a light source 61 irradiates the toner image (i.e., the test image) on the intermediate transfer belt 25 with light. The light reflected from the toner image is focused on a photoelectric transfer element 63 (e.g., CCDs) through a focusing lens 62. Thus, the toner image on the intermediate transfer medium 25 is read. In this case, the photoelectric transfer element 63 may be one-dimensional line sensors in which elements are arranged in one dimension or two-dimensional area sensors in which elements are arranged in two dimension.

FIG. 7 illustrates examples of the test image to be-formed on the image bearing member such as photoreceptors and intermediate transfer media, in which dot images or line images are periodically arranged.

Figure 8:
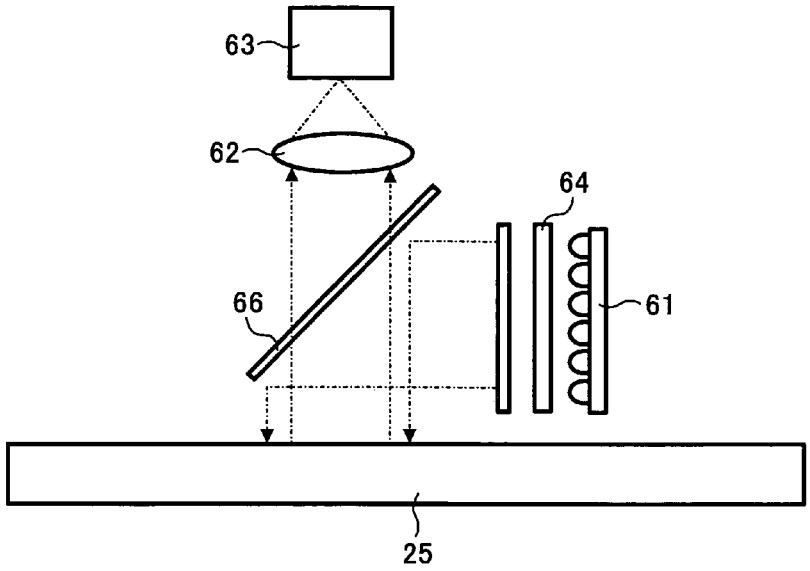
FIG. 8 is a schematic view illustrating another embodiment of the pattern detector included in the image forming apparatus of the present invention.

FIG. 8 is a view illustrating another embodiment of the pattern detector 60 in which substantially parallel light beams illustrate the test image and the mirror reflection light beams reflected from the test image on the intermediate transfer belt 25 are focused. In FIG. 8, the light source 61 is a one-dimensional or two-dimensional LED array. The light beams emitted by the light source 61 are changed to diffusion light beams by a diffusion plate 64. Then the light beams are passed through a light control film so that the transmitted light beams are controlled so as to be oriented and paralleled. Then the paralleled light beams are reflected by a half mirror 66 so as to vertically illustrate the test image on the intermediate transfer medium 25. The light beams reflected from the test image on the intermediate transfer belt 25 are focused on the photoelectric transfer element 63 by a focusing lens 62. Thus, the test image on the intermediate transfer belt 25 is optically read.

The method of paralleling light beams is not limited to the above-mentioned method using a functional film such as light control films, and methods using a combination of lenses can also be used therefor.

In addition, the illumination direction and focusing direction are not limited to the vertical irradiation, and any methods in which mirror reflection light beams can be detected can be used. However, when a two-dimensional image is formed on an area sensor using light beams in an oblique direction, it is necessary to correct the image to prevent distortion of the image.

Then the image quality predicting section 240 predicts the image qualities of the image to be output on the recording material such as papers on the basis of the evaluation data provided by the image measuring section 230.

The process condition calculating section 250 determines the process conditions, under which images are to be produced, on the basis of the image quality data provided by the image quality predicting section 240. In this case, it is preferable that the image qualities are compared with reference values which are previously determined and the process conditions are adjusted while assigning a higher priority to an image quality which deviates further from the reference value thereof.

When a test image (a dot image) is formed on the photoreceptor and then transferred to the intermediate transfer belt 25 to determine the areas of the dots, a considerable amount of toner particles are scattered in the transferring process. In general, such toner particles have a small particle diameter and therefore are hardly transferred to a receiving material in reality. Namely, such fine toner particles hardly influence the final image qualities (i.e., the image qualities of the image on the receiving material). Therefore, it is preferable that the image qualities of the test image on the intermediate transfer belt 25 are evaluated while disregarding such fine toner particles included in the dot image. By using such an evaluation method, more precise image quality prediction can be made.

Then the image quality prediction made by the image quality prediction section 240 will be explained in detail.

In general, granularity, clearness and gradation property are most important elements of an image. By evaluating such elements, the image quality of the image can be well evaluated. Needless to say, the elements are not limited thereto, and elements such as banding, color misalignment and background development can also be evaluated together with the elements.

At first, the method for evaluating granularity will be explained. The test dot image illustrated in FIG. 7 is a dot image with 600 dpi, 150 lines (i.e., number of dithers per inch) and 0 degree (i.e., angle of dithers). Each of the dots is constituted of 2×2 dots (i.e., two dots in each of the horizontal and vertical directions). As a result of the present inventors investigation, it is found that the reproducibility of 1×1 dot (i.e., only one dot image) is seriously bad, namely, correlation between the area of a 1×1 dot image and granularity of the resultant half tone image is low. Therefore, it is preferable to use at least 1×2 dot images (i.e., one dot in the horizontal (vertical) direction and two dots in the vertical (horizontal) direction) and preferably 2×2 dot images to precisely evaluate the granularity of the image.

Figure 9:
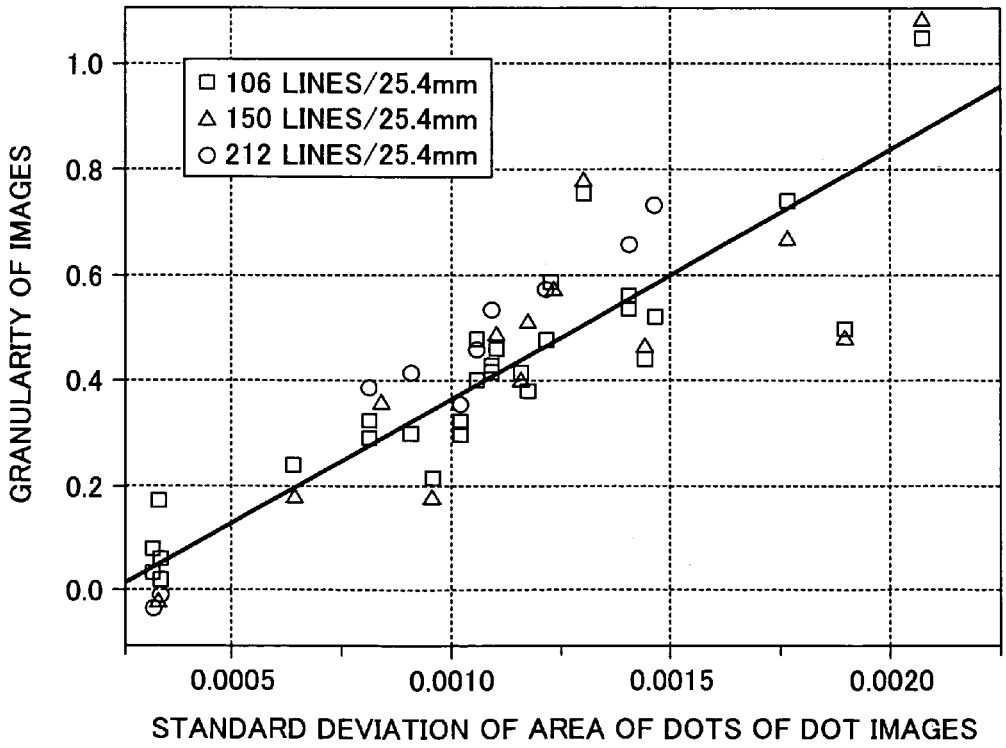
FIG. 9 is a graph showing the relationship between the standard deviation of the area of the test dot image and the granularity of the output images.

FIG. 9 is a graph showing the relationship between the standard deviation of the areas of dots of the dot images which are illustrated in FIG. 7 and which are formed on the intermediate transfer belt 25 and the granularity of a plurality kinds of half tone images which are practically output. It can be understood from FIG. 9 that there is a high correlation between the standard deviation of the areas of dots of the dot images and the average granularity of the practically output images. In this regard, the granularity of the output images is determined by the method described in JP-A 10-23191 incorporated herein by reference. The abstract of the method is as follows.

(1) at first, the red (R), green (G) and blue (B) image signals are changed to a L*, a* and b* chromaticity coordinate;
(2) the variation of the spatial frequency components of each of L*, a* and b* data is determined;
(3) the spatial frequency components are corrected so as to match the visual evaluation of human being (i.e., low spatial frequency components are mainly considered);
(4) the corrected spatial frequency components are integrated to determine the noise (granularity) of the test image; and
(5) the granularity is corrected while taking the brightness into consideration because even when test images have the same granularity, human being feels that the lighter image is more granular than the darker image.

Therefore, by measuring the standard deviation of the area of dots of the dot image, the average granularity of an image to be output can be predicted even when the image is not practically output on a paper.

Figure 10:
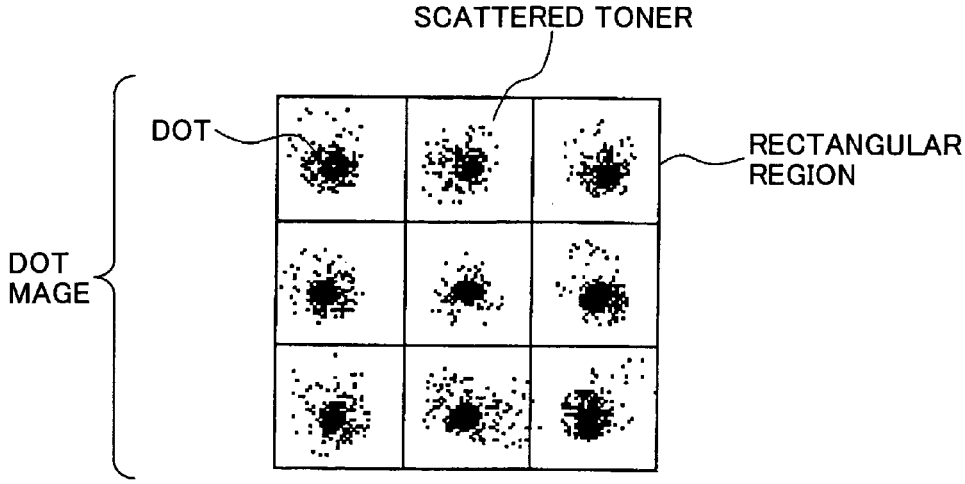
FIG. 10 illustrates the test dot image in which each dot image is included in a square.

The method for determining the area of dots of the dot image will be explained. As illustrated in FIG. 10, the dot image is separated so that the dots are included in the respective rectangular regions. The reflectivity of each of pixels included in a rectangular region is measured, and the reflectivity data are binarized (i.e., black or white) to determine the number of black pixels which have a reflectivity lower than a predetermined threshold value. The number of black pixels are multiplied by the area of the pixel to determine the total area of the black dot image in the rectangular region. Thus, all the areas of the dots are determined.

The relationship between the standard deviation of areas of dot images and granularity of the half tone images, which illustrated in FIG. 9, is obtained from experiments which are performed while changing the line densities to be 106, 150 and 212 lines per inch (i.e., lines per 25.4 mm). It is clear from FIG. 9 that the granularity of images does not depend on the line density if the images have the same pattern.

Therefore, in order to predict the granularity of images, the same test image pattern is used even when the image forming apparatus used for outputting the image and the half tone image processing conditions under which the image is produced are different. If a different test image pattern is used, the gradient of the regression line as illustrated in FIG. 9 is changed. Therefore, precise image quality prediction cannot be made.

It is possible to determine the standard deviation of diameter of circles having the same area as that of the dot images (hereinafter referred to as same-area circles); the standard deviation of area ratio of the area of the dot images to the area of the rectangular region; or the standard deviation of brightness or density of the rectangular regions which is calculated from the above-mentioned area ratio of the dot images, instead of the standard deviation of area of the dots of the dot image mentioned above.

When the standard deviation of area of dot images is used, the granularity of an image to be output is predicted by the following equation (1):

$$\text{Granularity}=472.5\times(s)-0.1 \quad (1)$$

wherein s represents the standard deviation of area of dots of the dot image.

When the standard deviation of diameter of same-area circles is used instead of the area of dots of the dot image, the diameter r of a same-area circle is determined by the following equation:

$$r=\sqrt{(S/\pi)}$$

wherein S represents the area of the corresponding dot image.

Then the method for predicting gradation property of the image to be output will be explained.

Figure 11:
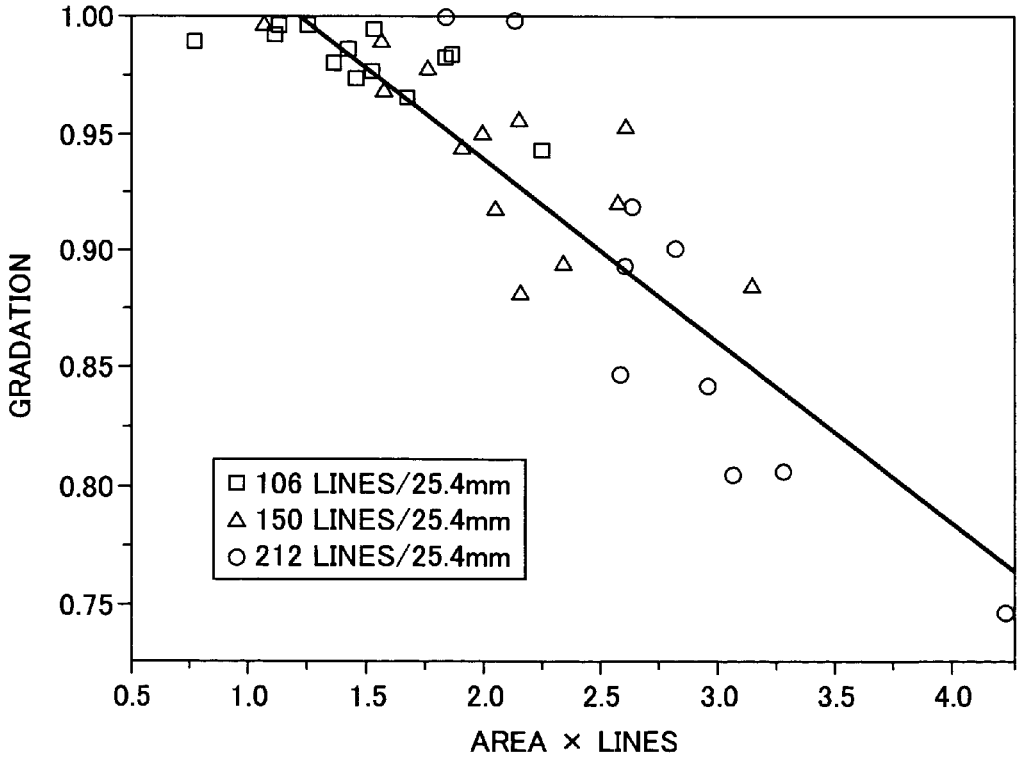
FIG. 11 is a graph showing the relationship between the product of the average area of the test dot image and the line number of the test line image, and the granularity of the output images.

FIG. 11 illustrates the relationship between products of area of dots of the test image (which is determined as mentioned above) and line number of the test image, and the linearity of brightness of the output half tone images (i.e., square of the regression coefficient of the brightness scatter chart). The gradation property (i.e., the linearity of brightness) is estimated by the following equation (2) but is not limited thereto:

$$\text{Gradation property}=-0.23\times D\times L-0.5 \quad (2)$$

wherein D represents the area of dots of a test image and L represents the line number of the test image.

In this regard, an image having a higher gradation property (i.e., a higher linearity of brightness) (i.e., a gradation property nearer to 1.0) means an image having a better half tone property. The brightness is linearly related to the human being's sensate brightness. When the characteristics of the image to be output are linearly related to brightness, the resultant half tone images have a property such that the differences in image density between a half tone image and the adjacent half tone image are the same. This is the most preferable image forming condition.

Finally the method for estimating the clearness will be explained.

Figure 12:
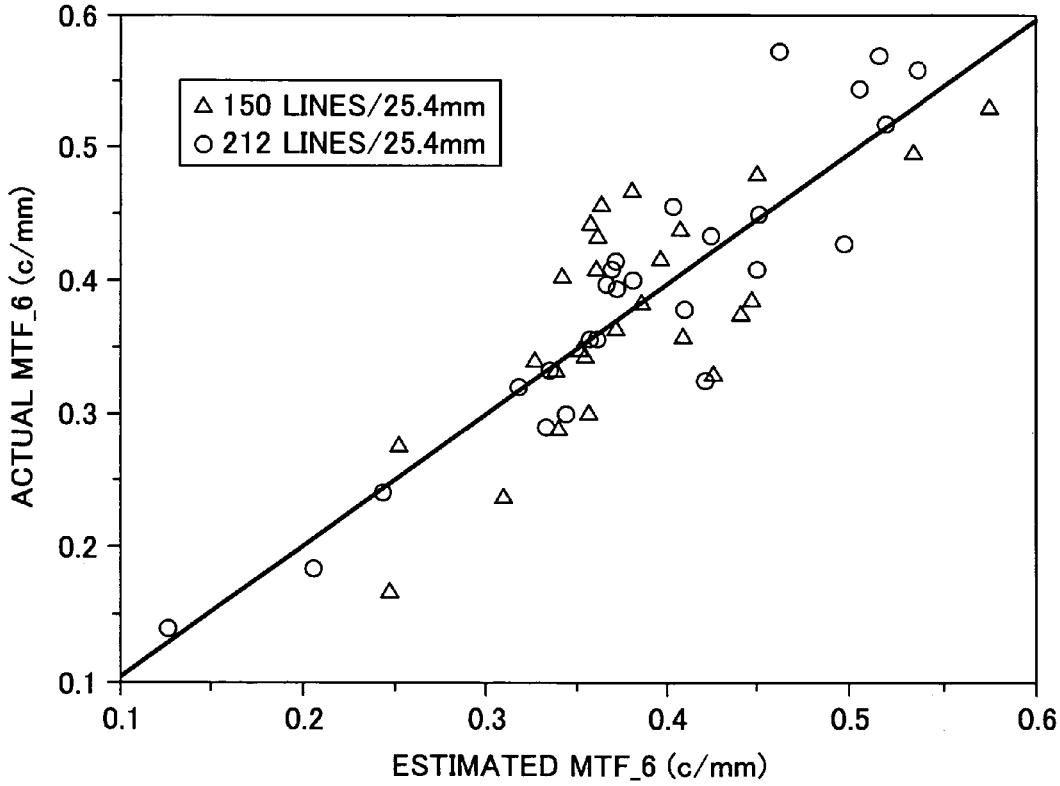
FIG. 12 is a graph showing the relationship between the estimated MTF using equation (3) and the real MTF at a spatial frequency of 6 c/mm.

FIG. 12 illustrates the relationship between the estimated MTF (modulation transfer function) which is estimated using the below-mentioned equation (3) and the actual MTF at a spatial frequency of 6 c/mm.

$$\text{Clearness}=-4.6\times|Wi-Wa|-4.1\times(We)+0.76 \quad (3)$$

wherein Wi and Wa represent the ideal line width and the actual line width of the line image, respectively, and We represents the width of edge of the line image.

The estimation of MTF can be made by not only the method using equation (3) but also a method in which MTF is estimated using the number of toner particles present in the test line image or the area of the scattered toner particles.

The line width is determined by the following method:

(1) the detected test line image is binarized by comparing the density to a threshold image density which is determined from the maximum and minimum reflectivity of the line image; and (2) the width (i.e., the number of pixels in the width direction) of the binarized line image is calculated.

The method for determining the line width of a line image is defined in JIS X 6930 incorporated herein by reference, and this method can also be used in the present invention.

The width of edge of a line image is determined by the following method:

(1) a first width of a line image is determined using a predetermined first threshold value;

(2) a second width of the line image is determined using a second threshold value;

(3) the difference (D) (absolute value) between the first and second line widths is determined; and (4) the width of edge of the line image is defined as D/2.

Then the method for adjustment of the image forming conditions will be explained.

Figure 13:
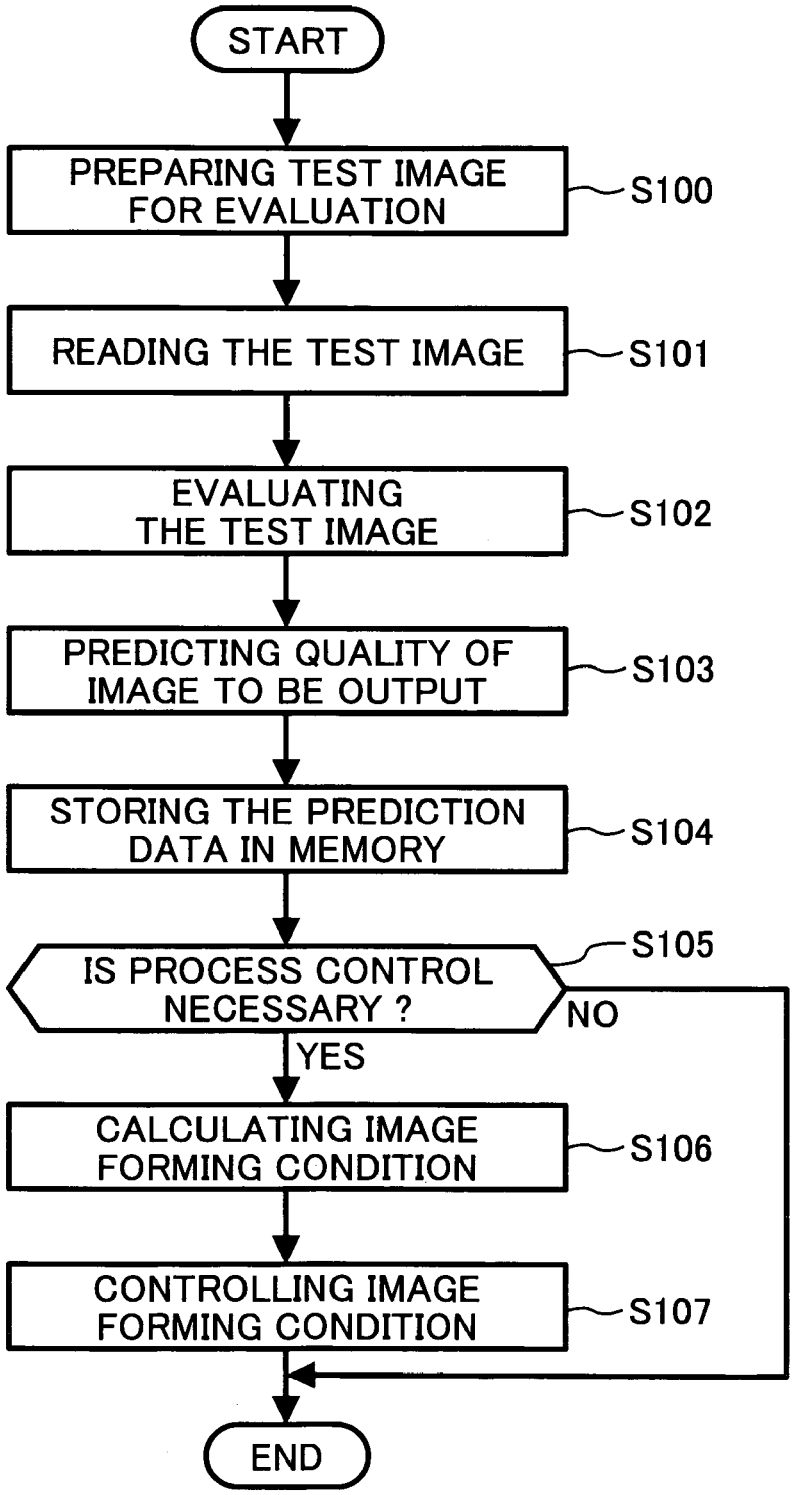
FIG. 13 is a flowchart for explaining a procedure for determining the image forming condition adjustment.
Figure 14:
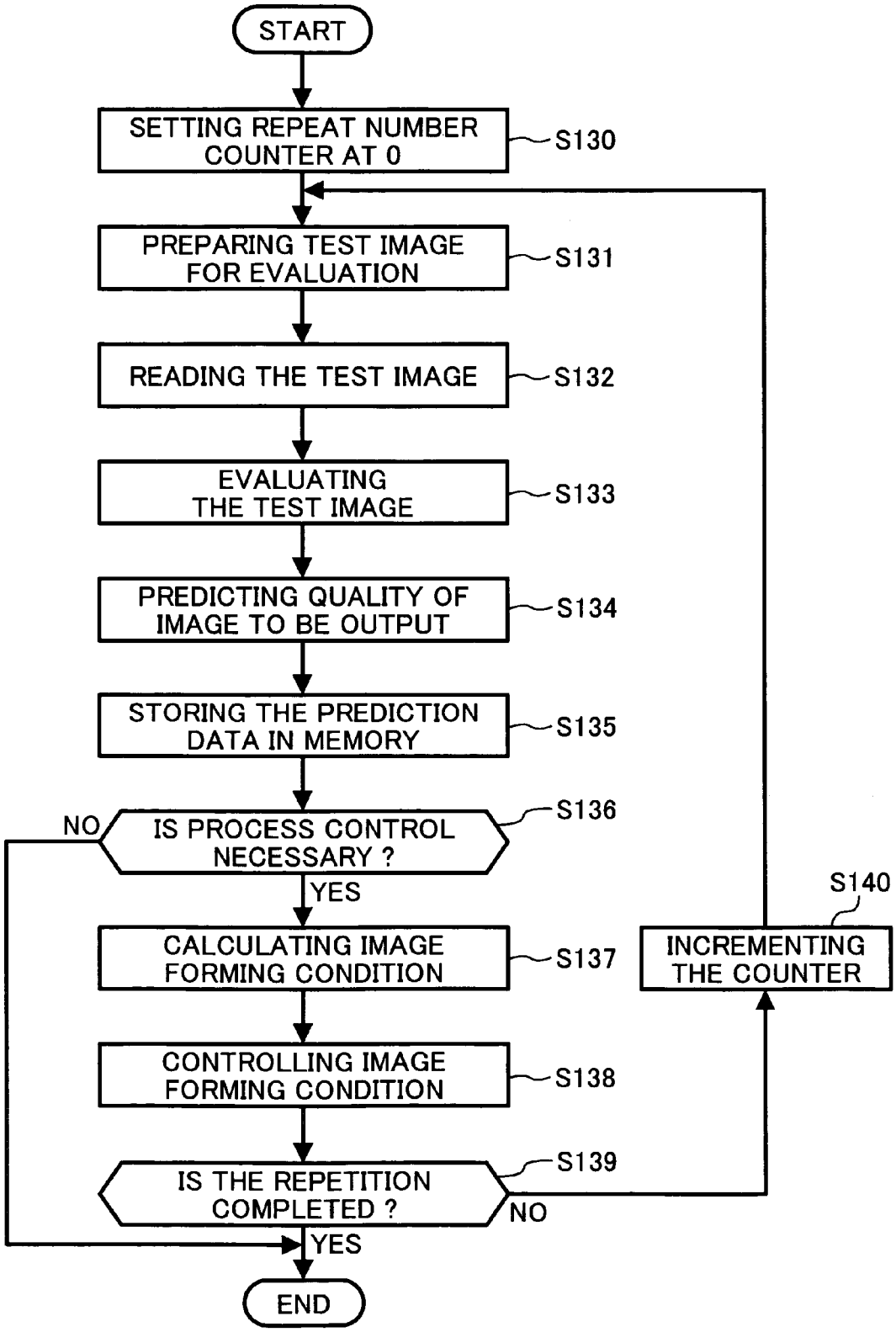
FIG. 14 is a flowchart for explaining another procedure for determining the image forming condition adjustment.

FIGS. 13 and 14 are flowcharts for explaining how the adjustment to be made in image forming conditions is determined on the basis of the formal properties of a test dot image or a test line image formed on a photoreceptor or an intermediate transfer medium.

At first, a test image is formed on an intermediate transfer medium (STEP S100). The thus prepared test image is read by the pattern detector 60 of the image evaluating section 230 (STEP S101). The read image is temporarily stored in the image memory 231, and the image is analyzed by the analyzer 232 of the image evaluating section 230 to determine the formal properties of the test image such as area of dots of the dot image, standard deviation of the area, width of the line image, and width of edge of the line image (STEP S102).

Then the image quality predicting section 240 predicts the image qualities of an image to be output on a receiving material such as papers on the basis of the data provided by the image evaluating section 230 (STEP S103). The prediction results are stored in the memory 260 of the image forming apparatus 200 (STEP 5104).

In this case, it is determined whether or not the estimated image qualities are acceptable. If it is determined that process control is necessary (YES in STEP S105), the process condition calculating section 250 determines the image forming condition to be adjusted and the degree of the adjustment on the basis of the image quality data estimated by the image quality predicting section 240 (STEP S106). Then the image forming condition is adjusted on the basis of the adjustment data provided by the process condition calculating section 250 (STEP S107). Thus, the processing is completed.

When the predicted image quality is acceptable (NO in STEP S105), the image forming condition is not changed and thereby the processing is completed.

As mentioned above, the granularity, gradation property and clearness of an image to be output on a receiving material such as papers can be predicted from the formal data of the test dot image and the test line image formed on the photoreceptor or the intermediate transfer medium without actually forming a toner image on the receiving material.

In addition, it can be determined which property is most deteriorated when considering the image qualities of the image to be output. Therefore, the image forming conditions are adjusted while assigning a higher priority to the property. For example, when the granularity property is most deteriorated, namely, when the reproducibility of the dot image is bad, it is preferable that the light quantity of light beams is increased to increase the size of each dot image, thereby stably forming images with good granularity.

However, it is rare that an image forming condition (e.g., light quantity of light beams) is related to only one property (e.g., granularity), and in almost all cases such an image forming condition is related to various properties. For example, there is a case where adjustment for improvement in the granularity property deteriorates other properties such as gradation property. Therefore, it is preferable that the evaluation of a test image and adjustment of image forming conditions are repeated several times to determine the most suitable image forming conditions.

Then the method for determining the most suitable image forming conditions will be explained.

FIG. 14 is a flowchart for explaining the way to determine the most suitable image forming conditions by repeating the evaluation of a test image and adjustment of image forming conditions several times.

The processing illustrated in FIG. 14 is the same as that illustrated in FIG. 13 except that the evaluation of test images and adjustment of image forming conditions (STEPS S130 to S138) are repeated at predetermined times, namely, in STEP S139 it is judged whether the repetition is completed at the predetermined times. Therefore, the detailed explanation of the processing illustrated in FIG. 14 is omitted.

In the processing illustrated in FIG. 14, the processing can be completed when the number of repetition is less than the predetermined repetition number if the predicted image qualities become acceptable. In addition, it is preferable that the adjustment of image forming conditions is not repeated greater than the predetermined times even when the image qualities are not acceptable, to avoid excessive adjustment.

In a case of a color printer, the image quality prediction on the basis of the evaluation data of the formal properties of a test image is preferably made for each of the color units, but it is possible that the image quality estimation is made only for a representative color unit (such as a black color unit) and the prediction data are applied to the other color units to adjust the image forming conditions of all the color units.

The image quality prediction can be made using a Mahalanobis distance. For example, an experiment in which the image forming conditions are changed to produce images having different image qualities. Then the image qualities of the images are visually evaluated to choose images with good image qualities. Using the chosen images, a reference space is formed. Then the Mahalanobis distance of each of the properties of a test image formed on the photoreceptor or the intermediate transfer medium is calculated using the reference space. Then the image qualities of an image to be output are predicted using the Mahalanobis distance. In addition, it is possible that the smaller-is-better SN ratio for each evaluation data is determined and then the image qualities are predicted on the basis of the smaller-is-better SN ratio.

By using the method using the Mahalanobis distance, evaluation data having different dimensions (such as area of dot images and width of line images) can be handled similarly using the Mahalanobis distance from the reference space and therefore the image quality prediction can be efficiently performed (i.e., the evaluation scale can be established.

As mentioned above, by predicting the image qualities of an image to be output on the basis of the evaluation data of formal properties of a test image formed on an image bearing member such as photoreceptors and intermediate transfer media, and adjusting the image forming conditions while considering the granularity, clearness and gradation property, high quality images without abnormal images can be stably produced. Therefore, it becomes possible to provide an image forming apparatus which satisfies customers and which carries out low cost operations.

The method of the present invention has an advantage such that the evaluation of image qualities of a test image is hardly influenced by uneven image density of the image formed on an image bearing member, over conventional methods in which image density is measured using a photosensor. Therefore, the test image can be precisely evaluated and thereby the image qualities of an image to be output can be precisely predicted. Since the image forming conditions of the image forming apparatus are adjusted on the basis of the thus obtained evaluation data, the image qualities of the output image can be controlled so as to be visually good. Therefore, high quality images without abnormal images can be stably produced.

In addition, even when the materials of the image bearing member such as photoreceptors and intermediate transfer media are changed, a service men need not to change the reference values with which the formal properties of a test image are to be compared. Therefore, a problem in that the correction accuracy of the formal properties deteriorates due to variation of the materials caused by change of lots, etc., can be avoided, resulting in improvement of reliability of the image forming apparatus in view of image qualities. Further, the down time of the image forming apparatus can be reduced, namely, the utilization rate of the image forming apparatus can be increased.

In the image forming apparatus of the present invention, a test image formed on an image bearing member is evaluated, and the evaluation data of the test image are fed back to adjust the image forming conditions. Namely, a receiving sheet is not used for evaluating the test image, and therefore a problem in that the running costs increase can be avoided, resulting in reduction of TCO (total cost of ownership).

In addition, reference values with which the image qualities of an image to be output are compared are previously set. The image forming apparatus of the present invention has a function such that when the predicted image qualities of the image to be output are lower than the reference values, the information is provided to a previously registered person or maintenance man. Therefore, customers become free from a work of checking the image forming apparatus to determine whether the performance thereof deteriorates. In addition, even when the image qualities deteriorate, the time needed for recovering the image forming apparatus is short, resulting in increase of the reliability of the image forming apparatus. Further, the down time of the image forming apparatus can be reduced, namely, the utilization rate of the image forming apparatus can be increased.

Figure 15:
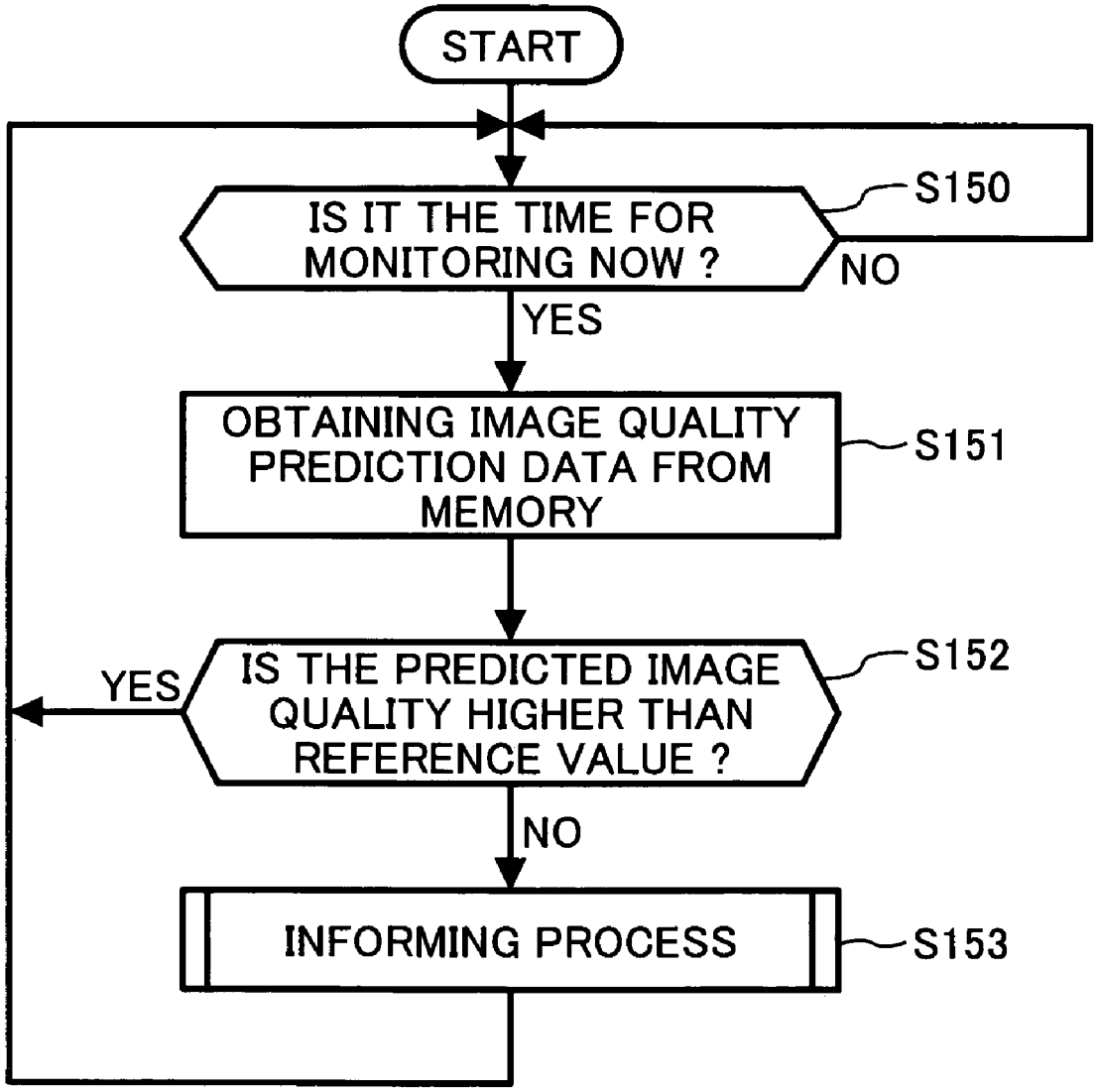
FIG. 15 is a flowchart for explaining a procedure for informing deterioration of image qualities.

Then the method for informing deterioration of image qualities of the image to be output will be explained referring to FIG. 15.

This processing is automatically performed after the power is applied to the image forming apparatus and various initialization operations are carried out. The image qualities of an output image are checked at a predetermined interval to determine whether the image qualities deteriorate. When it is the time for monitoring (YES in Step S150), the image quality prediction data stored in the memory 260 are obtained (Step S151). The predicted image quality is compared with the predetermined reference value. When the image quality is not higher than the reference value (NO in Step S152), the informing process is carried out (Step S153). Then the operation returns to Step S150.

When the predicted image quality is higher than the reference value (YES in Step S152), the operation returns to Step S150.

Figure 16:
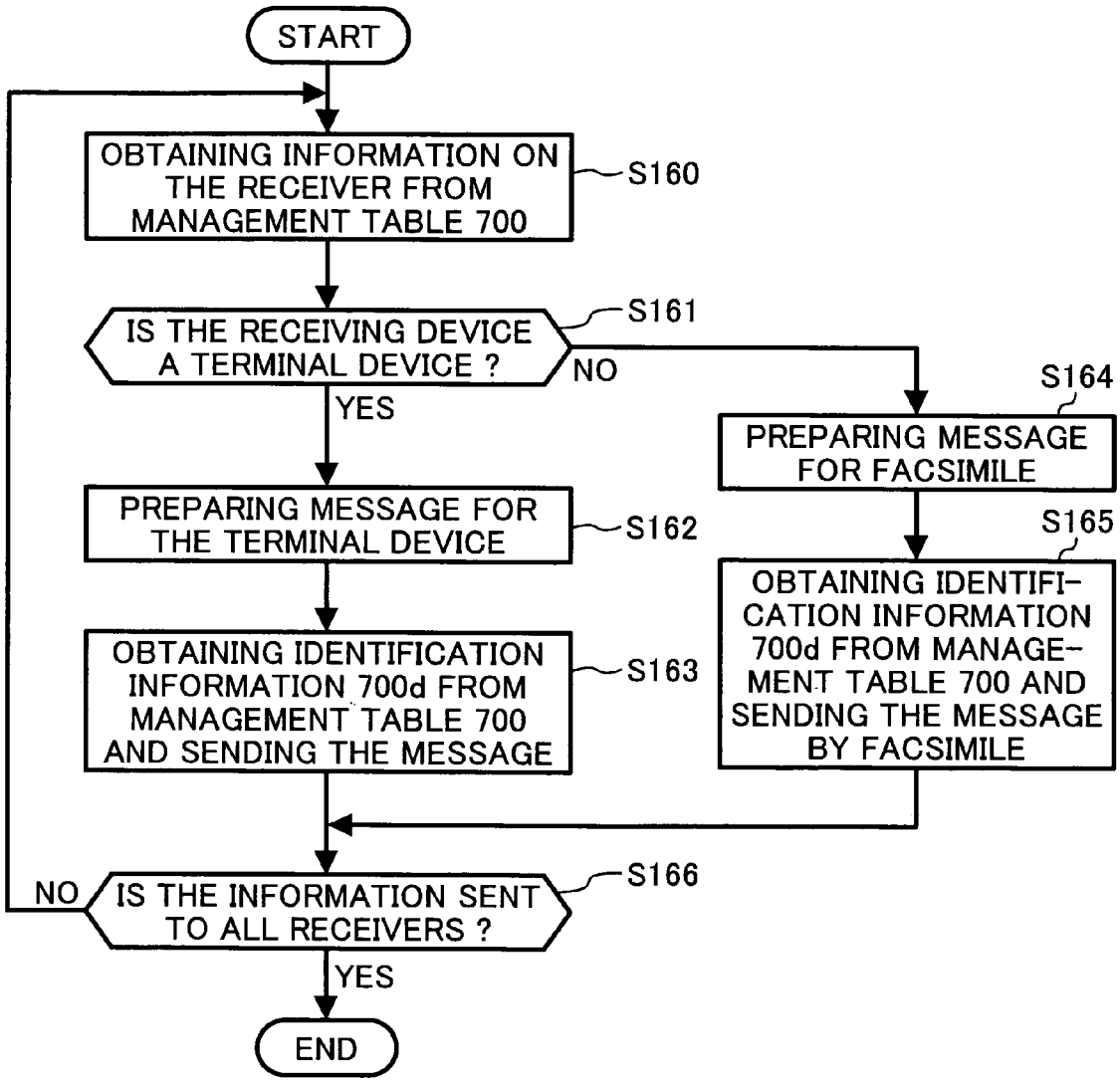
FIG. 16 is a flowchart for explaining a procedure for informing various kinds of information.

Then the method for providing various kinds of information on the image forming apparatus to a registered person (such as persons in charge of maintaining or managing the apparatus) will be explained referring to FIG. 16.

At first, by accessing the management table 700, information on the receiver to which information is to be sent is obtained (Step S160).

Then information on the type 700*c* of the apparatus is obtained to confirm the type of the apparatus of the receiver. When the apparatus is a terminal device (YES in Step S161), a message for the terminal device is prepared (Step S162), and a network address (IP address) in the entry of identification information 700*d* is obtained. Then the controller 290 delivers the message prepared above to the network through the connector 300 (Step S163). When the information has been sent to all the registered persons (YES in Step S166), the operation is completed. When there is a receiver to which the information has not yet been sent (NO in Step S166), the operation returns to STEP S160.

When the apparatus of the receiver is a facsimile machine (NO in Step S161), a message for the facsimile machine is prepared (Step S164), and a facsimile number (FAX number) in identification information 700*d* is obtained. After calling the facsimile machine through the facsimile modem 310, the message is sent to the facsimile machine (Step S165). When the information has been sent to all the registered persons (YES in Step S166), the processing is completed. When there is a receiver to which the information has not yet been sent (NO in Step S166), the operation returns to Step S160.

As explained above, the image forming apparatus of the present invention has a function such that when the predicted image qualities of the image to be output are lower than the reference values, the information is provided to a previously registered person or maintenance man. Therefore, customers become free from a work of checking the image forming apparatus to determine whether the performance thereof deteriorates. In addition, even when the image qualities deteriorate, the time needed for recovering the image forming apparatus is short, resulting in increase of the reliability of the image forming apparatus. Further, the down time of the image forming apparatus can be reduced, namely, the utilization rate of the image forming apparatus can be increased.

In addition, a maintenance company (such as service center) or a maintenance men can easily grasp deterioration of performance of the image forming apparatus, and thereby quick action can be made by the maintenance company or maintenance men in such a case. Thus, the service qualities can be improved and the image forming apparatus can be differentiated from those of the competitors in view of maintenance service.

The image forming apparatus of the present invention can have a toner recycling function such that toner particles remaining on the image forming apparatus even after image transfer process is collected by the cleaning device 18 and the collected toner particles are returned to the toner hopper 50 to be mixed with a virgin toner and to be reused for developing electrostatic latent images. In this case, the image qualities are influenced by the content of the reused toner particles in the developer. Then the methods for determining the content of the reused toner particles, evaluating the image qualities and adjusting the image forming conditions will be explained.

The toner particles collected by the cleaning device 18 are re-stored in the toner hopper 50, and are mixed with the virgin toner therein. The thus mixed developer is supplied to the developing device 17. When a large number of images are produced, the content of the reused toner particles in the developer contained in the hopper 50 increases, thereby deteriorating the quality of the developer.

The amount of the collected toner particles can be determined from the amount of the toner supplied to the developing device 17 from the toner hopper 50. Specifically, by comparing the volume of the toner in the toner hopper 50 with the amount of the toner supplied to the developing device, the content of the collected toner in the hopper can be determined. Thus, the quality of the developer (toner) can be predicted.

Whether or not the quality of the developer deteriorates can be determined by estimating image qualities of the image to be output on the basis of the evaluation data of the test image. This method is superior in precision to methods in which the deterioration of the developer (toner) is judged from only the information on the amount (content) of the collected toner particles. It is possible to recover the image quality deteriorated due to deterioration of the developer to an extent by adjusting the image forming conditions. Therefore, it is preferable that the image forming conditions are adjusted on the basis of the information on the quality of the developer and the image quality prediction data.

In general, the collected toner particles have poor charge properties. Therefore, it is preferable to adjust (i.e., increase) the agitation time of the developer and the potential of the image bearing member (i.e., photoreceptor). It is also preferable to increase the quantity of light used for forming a latent image, the developing bias and transfer bias to produce high quality images.

However, there is a limit for such adjustment, and when the developer is seriously deteriorated, the image qualities cannot be improved so as to be higher than the predetermined image qualities. In this case, the developer (i.e., the toner hopper 50) is replaced.

Figure 17:
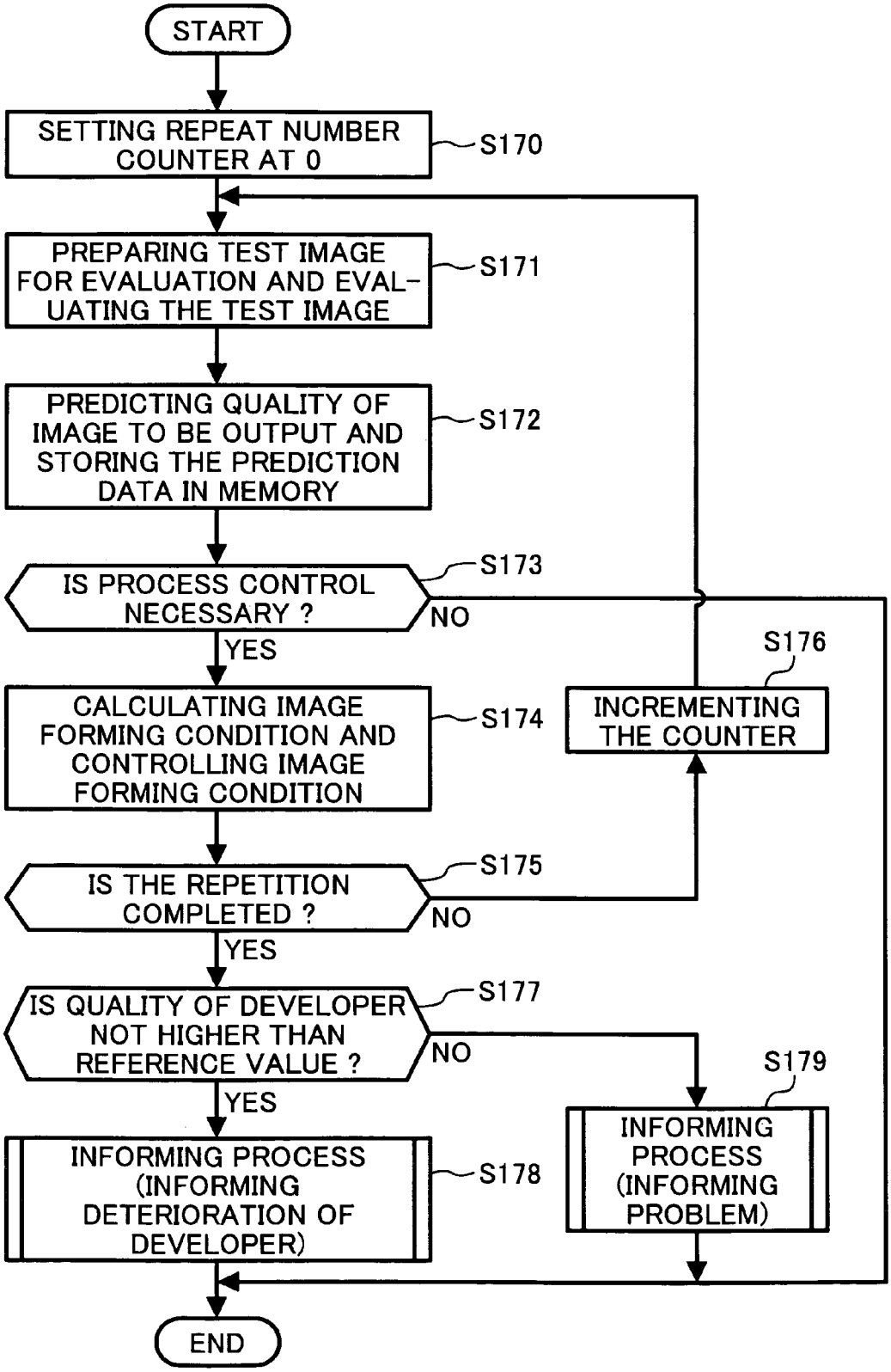
FIG. 17 is a flowchart for explaining an informing procedure when the developer deteriorates and an image quality problem occurs.

Then the action to be taken in the case where the predicted image qualities are low and the developer deteriorates will be explained referring to the flowchart illustrated in FIG. 17.

At first, the number of adjustment of image forming conditions is set to zero (i.e., initialized) (Step S170). A test image is formed on the intermediate transfer medium, and the test image is read by the patter detector 60 of the image evaluating section 230. The read image is temporarily stored in the image memory 231. The read image is evaluated by the analyzer 232 of the image evaluating section 230 with respect to an item such as area of dots of the test dot image, standard deviation of the area, line width of the test line image and width of edge of the test line image (Step S171).

Then the image quality predicting section 240 predicts the image qualities of an image to be output on a receiving material such as papers on the basis of the test image evaluation data provided by the image evaluating section 230. The predicted image qualities are stored in the memory 260 (Step S172).

When the process controlling is not necessary (NO in Step S173), this operation is completed because the image qualities of the image to be output are acceptable.

When the image qualities are not acceptable and therefore the process controlling is necessary (YES in Step S173), the process condition calculating section 250 determines the image forming condition to be adjusted and the degree of adjustment of the image forming condition. Thus, the image forming conditions of the image forming section 220 are controlled (Step S174).

When the repetition number is less than the predetermined number (NO in Step S175), the repetition number is incremented by one (Step S176), and then the operation returns to Step S171 to reexecute the next cycle of the operation.

When the repetition number is the same as the predetermined number (YES in Step S175), it is impossible to improve the image qualities by adjusting the image forming conditions. If the deterioration of image qualities is caused by deterioration of the developer (YES in Step S177), it is determined that the toner hopper 50 is replaced. Therefore, a message that the toner hopper should be replaced with new one is indicated in the display (not shown) of the control panel of the image forming apparatus 200 by illumination of lamp or alarm call to notify the users about the information (Step S178). Alternatively the information is sent, through the network, to a previously designated service center or a person in charge of managing the image forming apparatus 200. Thus, the informing process is carried out, and the operation is completed.

In a case where the developer does not deteriorate and the image forming section 220 deteriorates (NO in Step S177), a message that the image forming section has a trouble is indicated in the display (not shown) of the control panel of the image forming apparatus 200 by illumination of lamp or alarm call to notify the users about the information (Step S179). In addition, the information is sent, through the network, to a previously designated service center or person in charge of managing the image forming apparatus 200. Thus, the informing process is carried out, and the operation is completed.

As mentioned above, the image forming apparatus, which has a toner recycling mechanism, has a function to determine the time, at which the developer is to be replaced, on the basis of the information on the qualities of the mixed developer and the image qualities of the image to be output, which are estimated in view of granularity, clearness and gradation property. In addition, the image forming apparatus displays such information in the control panel and sends the information to a previously designated service center or person in charge of managing the image forming apparatus 200. Thus, the developer is replaced at the proper time (i.e., unnecessary replacement of developer can be avoided), and therefore the amount of wastes can be reduced, resulting in prevention of environmental pollution. In addition, the developer can be rapidly replaced, and therefore high quality images can be continuously produced. Thus, the image forming apparatus can satisfy customers in view of image quality and service quality.

Even when it is detected that the developer deteriorates, the image qualities can be improved to an extent by adjusting the image forming conditions, and thereby the life of the developer can be prolonged, resulting in reduction of running costs of the image forming apparatus.

Figure 18:
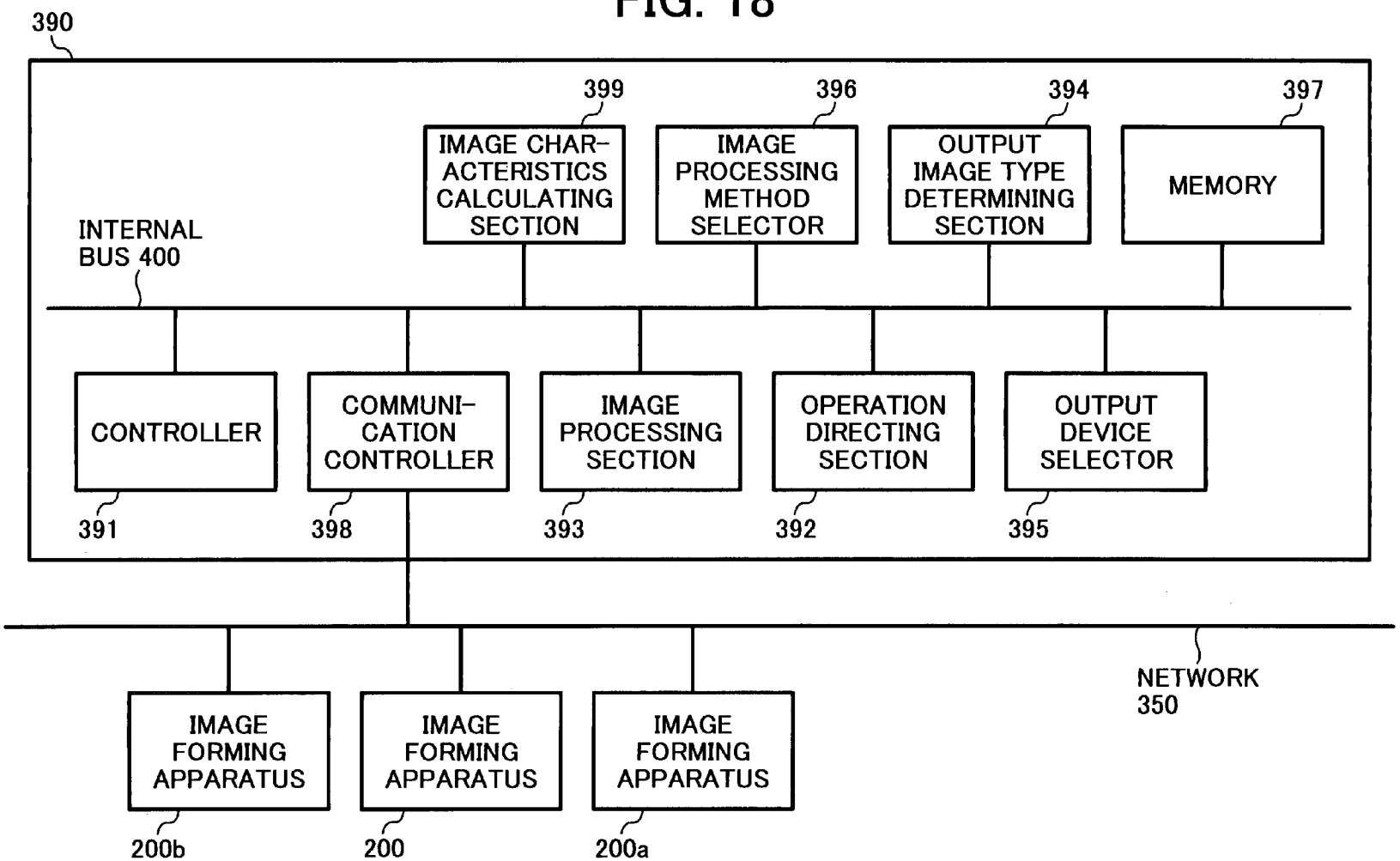
FIG. 18 is a schematic view illustrating an embodiment of the terminal device for use in the image forming system of the present invention.

FIG. 18 is a block diagram illustrating an embodiment of the image forming system of the present invention including image forming apparatus and a terminal device 390.

In FIG. 18, the terminal device 390 includes a controller 391, an operation directing section 392, image processing section 393, an output image type determining section 394, an output device selector 395, an image processing method selector 396, a memory 397, a communication controller 398, an image characteristics calculating section 399 and an internal bus 400.

These devices 391–399 are connected with the internal bus 400, and sending and reception of data and control instructions are performed through the internal bus 400.

The controller 391 controls the entire image forming apparatus 200 and each of the devices.

The operation directing section 392 includes a key board having operational keys and a display displaying various information, and is used for operating the terminal device 390.

The image processing section 393 carries out image processing suitable for the characteristics of the image forming apparatus.

The output image type determining section 394 recognizes the type of an image to be output (such as character images, pictorial images and figures), and determines the image forming apparatus from which the image is to be output and the image processing method on the basis of the information on the type of the image to be output.

The output device selector 395 selects the most suitable image forming apparatus among the image forming apparatuses 200, 200*a* and 200*b* on the basis of the information on the image to be output, so that high quality images can be produced.

The image processing method selector 396 selects the most suitable processing method so that the selected image forming apparatus can produce high quality images, and informs the image processing section 393 about the selected processing method.

The memory 397 temporarily stores the processing program which the controller 391 executes, and the above-mentioned various data and calculation results provided by the devices. In addition, the memory 397 serves as a work area of the controller 391.

The communication controller 398 has a NIC (Network Interface Card), and connects the image forming apparatus with ETHERNET® serving as the LAN 350. The communication controller 398 serves as a transmission controller such as TCP/IP and SMTP/POP.

The image characteristics calculating section 399 calculates the characteristics of an image to be output such as histogram distribution of the image, complexity of the image and spatial frequency characteristics of the image, and the information is used for selecting of suitable image forming apparatus and image processing method.

Figure 19:
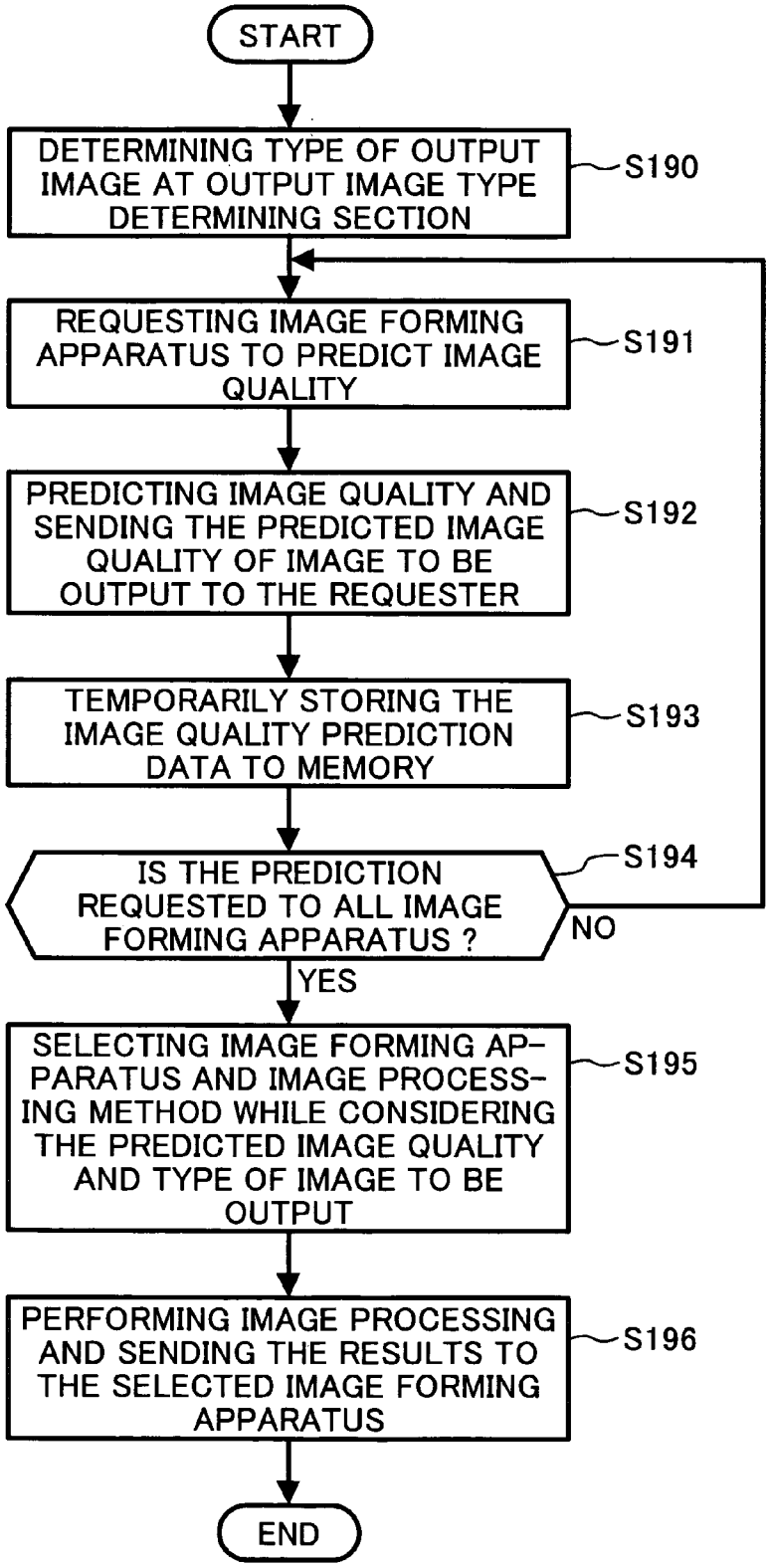
FIG. 19 is a flowchart for explaining a procedure for selecting a most suitable image forming apparatus for outputting an image.

Then the method for determining a suitable image forming apparatus among image forming apparatuses 200 to which the terminal device 390 requests to output an image through a network will be explained referring to FIG. 19.

When image processing is performed in the terminal device 390 which is connected with a network, the output image type determining section 394 determines the type of the image (e.g., character images, pictorial images, figures, etc.) to be output. The results are temporarily stored in the memory 397 (STEP S190) In this regard, the classification of types of images is not limited to the above-mentioned classification, and classifications based on characteristics of images such as histogram distribution, complexity and spatial frequency characteristics of images can also be available.

Then the terminal device 390 requests the image forming apparatuses 200 to predict the image qualities of an image to be output, and awaits the output image prediction results (Step S191).

Each of the image forming apparatuses 200 receiving the request forms a test image on an image bearing member such as photoreceptors and intermediate transfer media and evaluates the formal properties of the test image to predict the image qualities of an image to be output. Then the prediction data are sent to the terminal device 390 (Step S192).

When receiving the image quality prediction data, the terminal device 390 stores the prediction data in the memory 397 (Step S193).

If the terminal device 390 does not make the request to all the image forming apparatus 200 (NO in Step S194), the processing of from Step S191 to S194 is repeated.

When the terminal device 390 has made the request to all the image forming apparatuses 200 (YES in STEP S194), the output device selector 395 selects the most suitable image forming apparatus 200 and the most suitable image processing method (STEP S195).

If the output image is a character image, the output device selector 395 selects the most suitable image forming apparatus while assigning a priority to clearness of the image to be output rather than granularity thereof. If the output image is a pictorial image, the output device selector 395 selects the most suitable image forming apparatus while assigning a priority to granularity of the image to be output. If the output image includes both a character image and a pictorial image, the type of the output image can be determined from the image area proportion of the out image.

The image processing section 393 carries out image processing suitable for the image forming apparatus selected by the output device selector 395, and sends the data to the image forming apparatus so that the image forming apparatus can output the image (Step S196).

In this regard, the most suitable image processing is selected while considering the image quality prediction data (e.g., granularity, clearness or gradation property) and the type of the image to be output. For example, when gradation property or granularity is predicted to be poor, image processing is carried out while the density of dither and line density are set to be low. When gradation property or granularity is predicted to be good, image processing is carried out while the density of dither and line density are set to be high.

When gradation property is predicted is estimated to be poor, a plurality of sub-matrixes are used. In contrast, when gradation property is predicted to be good, the number of sub-matrixes used is lessened. When clearness is predicted to be poor, the density of dither are set to be low. In contrast, when clearness is estimated to be good, the density of dither is set to be high.

When only one image forming apparatus is connected with a network, the image forming apparatus selection is not performed, but proper image processing is performed while considering the function and characteristics of the image forming apparatus so that the image forming apparatus can produce an image with good image qualities.

In the case mentioned above, the image prediction is performed when the terminal device 390 requests the image forming apparatuses 200, which are connected with the network, to output an image. However, the image prediction method is not limited thereto.

For example, the image forming apparatus 200 may periodically perform image quality prediction and store the prediction results in the memory 260 thereof. When image output request is then made by the terminal device 390, the latest predicted data are sent to the terminal device 390. By using this method, the time needed for outputting an image can be shortened.

Alternatively, it is possible that the terminal device 390 periodically requests the image forming apparatuses 200 to predict the image qualities and stores the prediction data in the memory 397 of the terminal device 390. When it is requested to output an image, the terminal device 390 selects the most suitable image forming apparatus on the basis of the image quality prediction data.

In addition, it is possible that the image forming apparatus 200 periodically perform image quality prediction and send the prediction data to the terminal device 390 optionally after storing the estimation data in the memory 260.

As mentioned above, the latest information on the image qualities of an image to be output by the image forming apparatus 200 can be always grasped by the terminal device 390, and thereby the most suitable image forming apparatus can be selected upon request of outputting an image. Therefore, high quality images can be stably produced, and the image forming system can satisfy the customers.

The above-mentioned functions of the image forming apparatus and the terminal device can be programmed. The program can be stored in a recording medium such as CD-ROMs. Such a recording medium is set in a reading device of the image forming apparatus and the terminal device to be installed therein. The program installed can be executed by the CPU of the image forming apparatus and the terminal device. In this case, the image forming apparatus and the terminal device in which the program is installed perform the desired functions. Therefore, the program and the recording medium are also the invention.

The program can be provided for the image forming apparatus and the terminal device in the form of semiconductor devices such as ROMs and non-volatile memories, optical recording media such as DVDs, MOs, MDs and CDs, or magnetic recording media such as magnetic tapes and flexible discs. Alternatively, it is possible that the program is stored in a server computer, and the program is sent to the image forming apparatus and the terminal device. In this case, the storage device of the server computer is also considered to be a recording medium of the present invention.

In addition, the program can be combined with other programs such as operating system programs and application programs to perform the functions mentioned above.

This document claims priority and contains subject matter related to Japanese Patent Application No. 2003-397566, filed on Nov. 27, 2003, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

at least one image forming unit comprising, an image bearing member configured to bear an electrostatic latent image thereon, and a developing device configured to develop the electrostatic latent image with a developer comprising a toner to form a toner image on the image bearing member;

a transfer device configured to transfer the toner image on the image bearing member to a receiving material optionally via an intermediate transfer medium;

an image pattern measuring device configured to evaluate at least one geometric property of a test toner image formed on the image bearing member or the intermediate transfer medium;

an image quality predicting device configured to predict image qualities of the toner image to be formed on the receiving material on basis of evaluation data of the at least one geometric property of the test image; and an image forming condition adjusting device configured to adjust image forming conditions on the basis of image quality prediction data.

2. The image forming apparatus according to claim 1, wherein the image forming conditions are at least one of (1) quantity of charge formed on the image bearing member to form the electrostatic latent image, (2) light quantity of light irradiating the image bearing member to form the electrostatic latent image, (3) a developing bias applied to the developing device when the electrostatic latent image is developed, and (4) a transfer bias applied to the transfer device when the toner image is transferred to the receiving material.

3. The image forming apparatus according to claim 1, wherein the image forming apparatus repeats the test image formation, the test image evaluation, the image quality prediction and the image forming condition adjustment at a predetermined time to determine image forming conditions.

4. The image forming apparatus according to claim 1, wherein, the image forming apparatus includes a plurality of image forming units which produce different color images using respective color developers comprising respective color toners, the image pattern measuring device measures at least a geometric property of test color toner images formed on the respective image bearing members or the intermediate transfer medium, the image quality predicting device predicts the image qualities of the color toner images to be formed on the receiving material, and the image forming condition adjusting device adjusts image forming conditions for the respective image forming units on the basis of the respective image quality prediction data.

5. The image forming apparatus according to claim 1, wherein the image pattern measuring device evaluates the test toner image while disregarding toner particles which constitute the test toner image and have a particle size not greater than a predetermined particle size.

6. The image forming apparatus according to claim 1, wherein the image pattern measuring device comprises:

a light irradiator configured to irradiate the test image on the image bearing member or the intermediate transfer medium with light beams which are substantially parallel to each other;

a focusing member configured to focus the light beams reflected from the test image on the image bearing member or the intermediate transfer medium to form a light image of the test image;

a photoelectric transfer member configured to subject the light image to a photoelectric treatment; and an image analyzer configured to analyze the light image.

7. The image forming apparatus according to claim 1, wherein the image qualities predicted by the image quality predicting device include granularity, clearness and gradation property.

8. The image forming apparatus according to claim 7, wherein the image quality predicting device predicts the granularity on the basis of a standard deviation of areas of dots constituting the test image or a standard deviation of an average diameter of same-area circles having a same area as the dots.

9. The image forming apparatus according to claim 7, wherein the image quality predicting device predicts the gradation property on the basis of either an average area of dots constituting the test image or an average diameter of same-area circles of the dots and line density of the test image.

10. The image forming apparatus according to claim 7, wherein the image quality predicting device predicts the clearness from MTF (Modulation Transfer Function) at a predetermined spatial frequency, and wherein the MTF is determined on the basis of line width of the test image and width of an edge of the test image.

11. The image forming apparatus according to claim 1, wherein the image quality predicting device predicts the image qualities by comparing a Mahalanobis distance of the at least one geometric property of the test image with a predetermined Mahalanobis distance of the geometric property.

12. The image forming apparatus according to claim 1, further comprising:

a network connecting device configured to connect the image forming apparatus with a terminal device through a network, wherein the image forming apparatus sends data concerning at least one of the evaluation data of the at least one geometric property of the test image and the image quality prediction data to the terminal device through the network when requested by the terminal device.

13. The image forming apparatus according to claim 1, further comprising:

a network connecting device configured to connect the image forming apparatus with a terminal device through a network, wherein the image forming apparatus periodically sends at least one of the evaluation data of the test image and the image quality prediction data to the terminal device through the network connecting device and the network.

14. The image forming apparatus according to claim 1, further comprising:

an informing device configured to send information that the image quality deteriorates to a registered person when the predicted image quality is not better than a predetermined image quality.

15. The image forming apparatus according to claim 1, wherein the image forming apparatus determines whether the developer is to be replaced with a virgin developer on the basis of the image quality prediction data obtained after repeatedly performing the test image formation, the test image evaluation, the image quality prediction and the image forming condition adjustment, and wherein when it is determined that the developer is to be replaced with a virgin developer, the informing device sends the information to a registered person.

16. An image forming system comprising:

one or more of the image forming apparatus according to claim 1; and a terminal device which requests at least one of the one or more of the image forming apparatus, through a network, to output an image according to image data processed by the terminal device, wherein the terminal device prepares the image data by an image processing method which is determined on the basis of at least one of the image quality prediction data of the image to be output by the one or more of the image forming apparatus, which data are provided by the image quality predicting device thereof, and the test image evaluation data provided by the image pattern measuring device thereof.

17. The image forming system according to claim 16, wherein, the image forming system includes two or more of the image forming apparatuses, and the terminal device comprises an image forming apparatus selecting device configured to request the two or more of the image forming apparatuses to send at least one of the image quality prediction data and the evaluation data to select at least one among the two or more of the image forming apparatuses on the basis of the data, to which the terminal device requests to output the image through the network.

18. The image forming system according to claim 17, wherein the terminal device comprises:

a result storing device configured to store data of each of the two or more of the image forming apparatuses while associating the data with the respective image forming apparatus, and an image forming apparatus selecting device configured to select at least one among the two or more of the image forming apparatuses on the basis of the data stored in the result storing device to request to output the image.

19. The image forming system according to claim 18, wherein the terminal device periodically requests the two or more of the image forming apparatuses to send at least one of the image quality prediction data and the evaluation data.

20. The image forming system according to claim 18, wherein the two or more of the image forming apparatuses periodically send at least one of the image quality prediction data and the evaluation data to the terminal device, and the image forming apparatus selecting device selects at least one among the two or more of the image forming apparatuses on the basis of the data stored in the result storing device to request the apparatus to output the image.

21. The image forming system according to claim 18, wherein the image forming apparatus selecting device selects one among the two or more of the image forming apparatuses on the basis of the data stored in the result storing device and characteristics of the toner image to be output, and the terminal device determines an image processing method on the basis of the data stored in the result storing device and the characteristics of the image to be output.

22. The image forming system according to claim 18, wherein the image forming apparatus selecting device selects at least one among the two or more of the image forming apparatuses on the basis of the data stored in the result storing device and kinds of the toner image to be output, and the terminal device determines an image processing method on the basis of the data stored in the result storing device and the kinds of the image to be output.

23. An image forming apparatus, comprising:

at least one image forming unit comprising, an image bearing member configured to bear an electrostatic latent image thereon, and a developing device configured to develop the electrostatic latent image with a developer comprising a toner to form a toner image on the image bearing member;

a transfer device configured to transfer the toner image on the image bearing member to a receiving material optionally via an intermediate transfer medium;

an image pattern measuring device configured to evaluate at least one formal property of a test toner image formed on the image bearing member or the intermediate transfer medium;

an image quality predicting device configured to predict image qualities of the toner image to be formed on the receiving material on the basis of evaluation data of the at least one formal property of the test image;

an image forming condition adjusting device configured to adjust image forming conditions on the basis of image quality prediction data; and a developer supplying device which is exchangeable and which is configured to store and supply the developer to the developing device;

a developer collecting device configured to collect particles of the toner, which are adhered to the image bearing member but are not used for forming the toner image, to feed the collected toner particles to the developer supplying device; and a mixed developer quality determining device configured to determine a quality of a mixed toner of virgin toner particles and the collected toner particles;

wherein the image forming condition adjusting device determines the image forming conditions on the basis of the image quality prediction data and the quality of the mixed toner.

24. An image forming apparatus, comprising:

at least one image forming unit comprising, an image bearing member configured to bear an electrostatic latent image thereon, and a developing device configured to develop the electrostatic latent image with a developer comprising a toner to form a toner image on the image bearing member;

a transfer device configured to transfer the toner image on the image bearing member to a receiving material optionally via an intermediate transfer medium;

an image pattern measuring device configured to evaluate at least one formal property of a test toner image formed on the image bearing member or the intermediate transfer medium;

an image quality predicting device configured to predict image qualities of the toner image to be formed on the receiving material on the basis of evaluation data of the at least one formal property of the test image; and an image forming condition adjusting device configured to adjust image forming conditions on the basis of image quality prediction data, wherein the image pattern measuring device measures at least one of (1) a combination of an average of areas of dots constituting the test image and a standard deviation of the areas, (2) a combination of an average of diameters of the same-area circles of the dots and a standard deviation of the diameters, and (3) a combination of line width of the test image and width of edge of the test image.

25. An image forming condition adjusting method for adjusting an image forming condition of an image forming apparatus, comprising:

forming a test toner image on an image bearing member of the image forming apparatus using a developer comprising a toner;

measuring at least one geometric property of the test toner image;

predicting image qualities of a toner image to be output by the image forming apparatus on the basis of the geometric property data of the test toner image; and adjusting image forming conditions of the image forming apparatus on the basis of the image quality prediction data.

26. The image forming condition adjusting method according to claim 25, further comprising:

determining properties of the developer which includes a mixture of a virgin toner and a collected toner, wherein the predicting image qualities is performed on the basis of the geometric property data of the test toner image and the properties of the developer.

27. A computer program product which is stored in a computer readable storage medium and which carries out the image forming condition adjusting method according to claim 25.

28. A computer readable storage medium storing computer instructions for carrying out the image forming condition adjusting method according to claim 25.

* * * * *